US010301699B2

(12) United States Patent
Kawasaki et al.

(10) Patent No.: US 10,301,699 B2
(45) Date of Patent: May 28, 2019

(54) HOT-STAMPED PART AND METHOD OF MANUFACTURING THE SAME

(71) Applicant: NIPPON STEEL & SUMITOMO METAL CORPORATION, Tokyo (JP)

(72) Inventors: Kaoru Kawasaki, Tokyo (JP); Masafumi Azuma, Tokyo (JP); Genki Abukawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 143 days.

(21) Appl. No.: 14/899,267

(22) PCT Filed: Sep. 12, 2014

(86) PCT No.: PCT/JP2014/074184
§ 371 (c)(1),
(2) Date: Dec. 17, 2015

(87) PCT Pub. No.: WO2015/041159
PCT Pub. Date: Mar. 26, 2015

(65) Prior Publication Data

US 2016/0145704 A1 May 26, 2016

(30) Foreign Application Priority Data

Sep. 18, 2013 (JP) ..... 2013-193124

(51) Int. Cl.

| | |
|---|---|
| ***C21D 9/00*** | (2006.01) |
| ***C22C 38/38*** | (2006.01) |
| ***C22C 38/32*** | (2006.01) |
| ***C22C 38/28*** | (2006.01) |
| ***C22C 38/26*** | (2006.01) |
| ***C22C 38/00*** | (2006.01) |
| ***C22C 38/22*** | (2006.01) |
| ***C22C 38/20*** | (2006.01) |

(Continued)

(52) U.S. Cl.

CPC ..... *C21D 9/0068* (2013.01); *C21D 1/25* (2013.01); *C21D 1/673* (2013.01); *C21D 6/001* (2013.01); *C21D 6/005* (2013.01); *C21D 6/008* (2013.01); *C21D 7/13* (2013.01); *C21D 9/48* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/58* (2013.01); *C21D 2211/002* (2013.01); *C21D 2211/004* (2013.01); *C21D 2211/005* (2013.01); *C21D 2211/008* (2013.01)

(58) Field of Classification Search

CPC .... C21D 1/25; C21D 1/673; C21D 2211/002; C21D 2211/004; C21D 2211/005; C21D 2211/008; C21D 6/001; C21D 6/005; C21D 6/008; C21D 7/13; C21D 9/0068; C21D 9/48; C22C 38/00; C22C 38/001; C22C 38/002; C22C 38/005; C22C 38/02; C22C 38/04; C22C 38/06; C22C 38/20; C22C 38/22; C22C 38/24; C22C 38/26; C22C 38/28; C22C 38/32; C22C 38/38; C22C 38/58

See application file for complete search history.

(56) References Cited

U.S. PATENT DOCUMENTS

| | | | |
|---|---|---|---|
| 2006/0185774 | A1 | 8/2006 | Nishibata et al. |
| 2012/0118440 | A1 | 5/2012 | Nakanishi et al. |

(Continued)

FOREIGN PATENT DOCUMENTS

| | | | |
|---|---|---|---|
| CA | 2802033 | A1 | 12/2011 |
| CN | 102939399 | A | 2/2013 |

(Continued)

OTHER PUBLICATIONS

English translation of the International Preliminary Report on Patentability and Written Opinion of the International Searching Authority (forms PCT/IB/373, PCT/ISA/237 and PCT/IB/338), dated Mar. 31, 2016, for International Application No. PCT/JP2014/074184.

(Continued)

*Primary Examiner* — Jenny R Wu

(74) *Attorney, Agent, or Firm* — Birch, Stewart, Kolasch & Birch, LLP

(57) ABSTRACT

A hot-stamped part includes a chemical composition represented by, in mass %: C: 0.120% to 0.400%; Si: 0.005% to 2.000%; Mn or Cr, or both thereof: 1.00% to 3.00% in total; Al: 0.005% to 0.100%; B: 0.0003% to 0.0020%; P: not more than 0.030%; S: not more than 0.0100%; O: not more than 0.0070%; N: not more than 0.0070%; Ti: 0% to 0.100%; Nb: 0% to 0.100%; V: 0% to 0.100%; Ni: 0% to 2.00%; Cu: 0% to 2.00%; Mo: 0% to 0.50%; Ca or REM, or both thereof: 0% to 0.0300% in total; and the balance: Fe and impurities, and a structure represented by: an area fraction of martensite or bainite, or both thereof: not less than 95% in total; a coverage factor of prior austenite grain boundary by iron-based carbides: not more than 80%; and a number density of iron-based carbides in prior austenite grains: not less than $45/\mu m^2$.

8 Claims, 1 Drawing Sheet

(51) Int. Cl.

| | |
|---|---|
| ***C22C 38/06*** | (2006.01) |
| ***C22C 38/04*** | (2006.01) |
| ***C22C 38/02*** | (2006.01) |
| ***C21D 6/00*** | (2006.01) |
| ***C22C 38/24*** | (2006.01) |
| ***C22C 38/58*** | (2006.01) |
| ***C21D 7/13*** | (2006.01) |
| ***C21D 9/48*** | (2006.01) |
| ***C21D 1/25*** | (2006.01) |
| ***C21D 1/673*** | (2006.01) |

(56) References Cited

U.S. PATENT DOCUMENTS

| | | | |
|---|---|---|---|
| 2013/0048161 | A1 | 2/2013 | Matsuda et al. |
| 2013/0095347 | A1 | 4/2013 | Kawasaki et al. |
| 2014/0056754 | A1 | 2/2014 | Naitou et al. |
| 2014/0065007 | A1 | 3/2014 | Naitou et al. |
| 2015/0027602 | A1 | 1/2015 | Murakami et al. |
| 2015/0050519 | A1 | 2/2015 | Nonaka et al. |
| 2015/0090377 | A1 | 4/2015 | Murakami et al. |

FOREIGN PATENT DOCUMENTS

| | | | | |
|---|---|---|---|---|
| JP | 7-18322 | A | 1/1995 | |
| JP | 2005-205477 | A | 8/2005 | |
| JP | 2006-152427 | A | 6/2006 | |
| JP | 2008-264836 | A | 11/2008 | |
| JP | 2010-275612 | A | 12/2010 | |
| JP | 2011-161481 | A | 8/2011 | |
| JP | 2011-184758 | A | 9/2011 | |
| JP | 2012-180594 | A | 9/2012 | |
| JP | 2013-14842 | A | 1/2013 | |
| JP | 2013-79441 | A | 5/2013 | |
| JP | 2014-122398 | A | 7/2014 | |
| WO | WO-2011158818 | A1 * | 12/2011 | ..... B32B 15/013 |
| WO | WO 2012/169640 | A1 | 12/2012 | |
| WO | WO 2013/105631 | A1 | 7/2013 | |
| WO | WO 2013/133165 | A1 | 9/2013 | |
| WO | WO 2013/133166 | A1 | 9/2013 | |

OTHER PUBLICATIONS

International Search Report, issued in PCT/JP2014/074184, dated Dec. 9, 2014.
Office Action, issued in TW 103131930, dated Jul. 14, 2015.
Written Opinion of the International Searching Authority, issued in PCT/JP2014/074184, dated Dec. 9, 2014.
Korean Office Action dated Jan. 12, 2017, issued in corresponding Korean Patent Application No. 10-2016-7001941.
Extended European Search Report dated Mar. 7, 2017, issued in corresponding European Patent Application No. 14845667.6.
Canadian Office Action dated Jan. 30, 2017, issued in corresponding Canadian Patent Application No. 2,916,941.

* cited by examiner

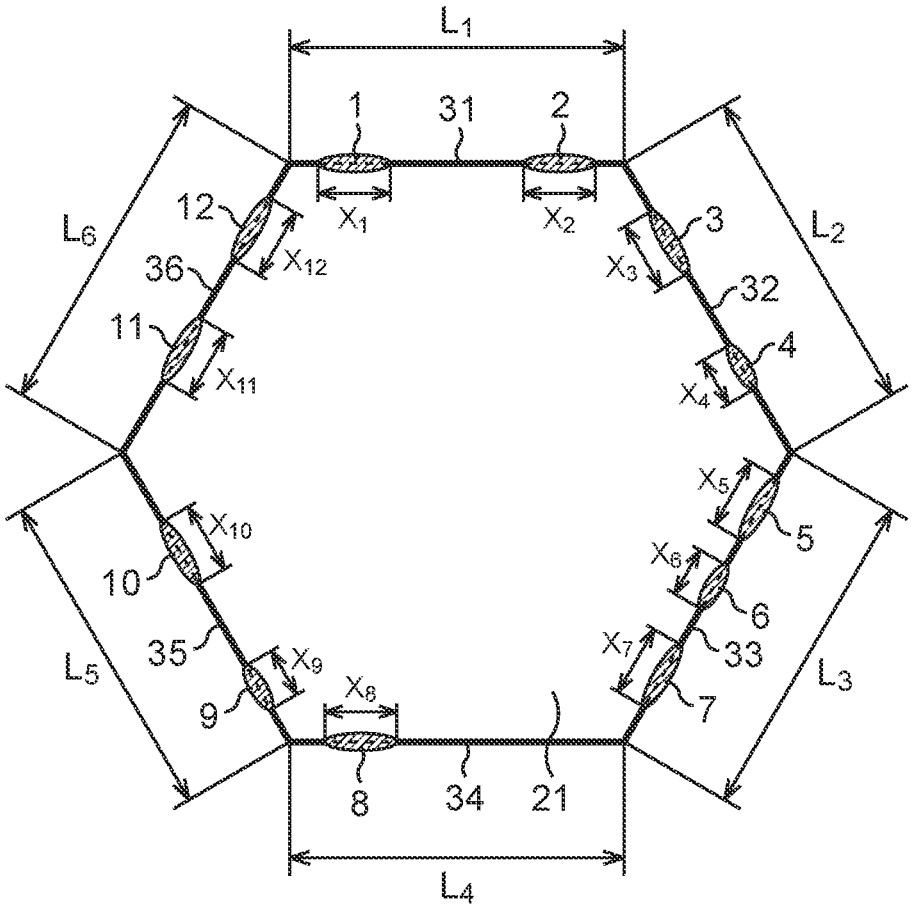
L1
1
31
2
X1
X2
L6
12
X12
36
11
X11
3
X3
32
L2
4
X4
X5
5
X6
6
33
X7
7
L3
X10
10
35
X9
9
L5
X8
8
34
21
L4

HOT-STAMPED PART AND METHOD OF MANUFACTURING THE SAME

TECHNICAL FIELD

The present invention relates to a hot-stamped part used for an automobile body or others, and a method of manufacturing the hot stamped part.

BACKGROUND ART

In recent years, weight reduction of an automotive body has been a crucial issue in the viewpoint of protecting global environments, and studies on the application of a high-strength steel sheet to a vehicle body part have been actively conducted. As the strength of a steel sheet used has been increasing still more, consideration on workability and shape fixability thereof have become important. Further, since the forming load in press forming increases as the strength of steel sheet increases, raising the pressing capability has also become a major issue.

Hot stamp forming (hereafter, also referred to simply as "hot stamping") is a technique in which a steel sheet is heated to a high temperature in an austenite range and subjected to press forming while it is at the high temperature. Since a softened steel sheet is formed in the hot stamp forming, it is possible to perform more complicated working. Moreover, in the hot stamp forming, since rapid cooling (quenching) is performed at the same timing as the press forming to cause the structure of the steel sheet to undergo martensite transformation, it is possible to achieve strength and shape fixability according to the carbon content of the steel sheet at the same time. Further, since a softened steel sheet is subjected to forming in the hot stamp forming, it is possible to significantly reduce the forming load compared with ordinary press forming which is performed at room temperature.

A hot-stamped part, which is manufactured through hot stamp forming, especially a hot-stamped part used for an automotive body requires excellent low-temperature toughness. A hot-stamped part is sometimes called a steel sheet member. Techniques relating to enhancements of toughness and ductility are described in Patent References 1 to 5. However, the techniques described in Patent Reference 1 to 5 cannot provide sufficient low-temperature toughness. Although Patent References 6 to 10 also disclose techniques relating to hot press forming or the like, they cannot provide sufficient low-temperature toughness as well.

CITATION LIST

Patent Reference

Patent Reference 1: Japanese Laid-Open Patent Publication No. 2006-152427

Patent Reference 2: Japanese Laid-Open Patent Publication No. 2012-180594

Patent Reference 3: Japanese Laid-Open Patent Publication No. 2010-275612

Patent Reference 4: Japanese Laid-Open Patent Publication No. 2011-184758

Patent Reference 5: Japanese Laid-Open Patent Publication No. 2008-264836

Patent Reference 6: Japanese Laid-Open Patent Publication No. 2011-161481

Patent Reference 7: Japanese Laid-Open Patent Publication No. 07-18322

Patent Reference 8: International Publication Pamphlet No. WO 2012/169640

Patent Reference 9: Japanese Laid-Open Patent Publication No. 2013-14842

Patent Reference 10: Japanese Laid-Open Patent Publication No. 2005-205477

SUMMARY OF THE INVENTION

Technical Problem

It is an objective of the present invention to provide a hot-stamped part which can achieve excellent tensile strength and low-temperature toughness, and a method of manufacturing the same.

Solution to Problem

The prevent inventors have conducted intensive studies on the cause of difficulty in achieving sufficient low-temperature toughness for a conventional hot-stamped part. As a result, it has been found that iron-based carbides precipitate nearly all over the prior austenite grain boundary and thereby intergranular fracture is more likely to occur. The present inventors have also found that the cooling rate during hot stamp forming is an important factor to inhibit the precipitation of iron-based carbides at prior austenite grain boundary.

Accordingly, based on these findings, the present inventors have come to conceive various aspects of the invention described below.

(1) A hot-stamped part including:

a chemical composition represented by, in mass %:

C: 0.120% to 0.400%;

Si: 0.005% to 2.000%;

Mn or Cr, or both thereof: 1.00% to 3.00% in total;

Al: 0.005% to 0.100%;

B: 0.0003% to 0.0020%;

P: not more than 0.030%;

S: not more than 0.0100%;

O: not more than 0.0070%;

N: not more than 0.0070%;

Ti: 0% to 0.100%;

Nb: 0% to 0.100%;

V: 0% to 0.100%;

Ni: 0% to 2.00%;

Cu: 0% to 2.00%;

Mo: 0% to 0.50%;

Ca or REM, or both thereof: 0% to 0.0300% in total; and the balance: Fe and impurities; and a structure represented by:

an area fraction of martensite or bainite, or both thereof: not less than 95% in total;

a coverage factor of prior austenite grain boundary by iron-based carbides: not more than 80%; and a number density of iron-based carbides in prior austenite grains: not less than 45/$\mu m^2$.

(2) The hot-stamped part according to (1), wherein the chemical composition satisfies:

Ti: 0.005% to 0.100%;

Nb: 0.005% to 0.100%; or

V: 0.005% to 0.100%; or any combination thereof.

(3) The hot-stamped part according to (1) or (2), wherein the chemical composition satisfies:

Ni: 0.05% to 2.00%;

Cu: 0.05% to 2.00%; or

Mo: 0.05% to 0.50%; or any combination thereof.

(4) The hot-stamped part according to any one of (1) to (3), wherein the chemical composition satisfies Ca or REM, or both thereof: 0.0005% to 0.0300% in total.

(5) A method of manufacturing a hot-stamped part, including the steps of:

heating a steel sheet to a temperature of not less than Ac3 point and not more than 950° C. at an average heating rate of not less than 2° C./sec;

then, cooling the steel sheet through a temperature range from a Ar3 point to (Ms point−50)° C. at an average cooling rate of not less than 100° C./sec while performing hot pressing; and then, cooling the steel sheet through a temperature range from (Ms point−50)° C. to 100° C. at an average cooling rate of not more than 50° C./sec, wherein the steel sheet includes a chemical composition represented by, in mass %:

C: 0.120% to 0.400%;

Si: 0.005% to 2.000%;

Mn or Cr, or both thereof: 1.00% to 3.00% in total;

Al: 0.005% to 0.100%;

B: 0.0003% to 0.0020%;

P: not more than 0.030%;

S: not more than 0.0100%;

O: not more than 0.0070%;

N: not more than 0.0070%;

Ti: 0% to 0.100%;

Nb: 0% to 0.100%;

V: 0% to 0.100%;

Ni: 0% to 2.00%;

Cu: 0% to 2.00%;

Mo: 0% to 0.50%;

Ca or REM, or both thereof: 0%-0.0300% in total; and the balance: Fe and impurities, and a maximum cooling rate is not more than 70° C./sec and a minimum cooling rate is not less than 5° C./sec in a temperature range from (Ms point−120)° C. to 100° C.

(6) The method of manufacturing the hot-stamped part according to (5), wherein the chemical composition satisfies:

Ti: 0.005%-0.100%;

Nb: 0.005%-0.100%; or

V: 0.005%-0.100%; or any combination thereof.

(7) The method of manufacturing the hot-stamped part according to (5) or (6), wherein the chemical composition satisfies:

Ni: 0.05%-2.00%;

Cu: 0.05%-2.00%; or

Mo: 0.05%-0.50%; or any combination thereof.

(8) The method of manufacturing the hot-stamped part according to any one of (5) to (7), wherein the chemical composition satisfies Ca or REM or both thereof: 0.0005%-0.0300% in total.

Advantageous Effects of Invention

According to the present invention, it is possible to achieve excellent tensile strength and low-temperature toughness.

BRIEF DESCRIPTION OF DRAWINGS

FIG. 1 is a schematic diagram illustrating a prior austenite grain, and iron-based carbides that have precipitated at the grain boundary.

DESCRIPTION OF EMBODIMENTS

Hereafter, embodiments of the present invention will be described. A hot-stamped part according to an embodiment of the present invention is manufactured, as described below in more detail, through hot stamp forming including quenching of a steel sheet for hot stamping. Thus, the hardenability and quenching conditions of the steel sheet for hot stamping affect the hot-stamped part.

In the beginning, a structure of a hot-stamped part according to the present embodiment will be described. The hot-stamped part according to the present embodiment includes a structure represented by: an area fraction of martensite or bainite, or both thereof: not less than 95% in total; a coverage factor of prior austenite grain boundary by iron-based carbides: not more than 80%; and a number density of iron-based carbides in prior austenite grains: not less than 45/$\mu m^2$.

(An Area Fraction of Martensite or Bainite, or Both Thereof: Not Less than 95% in Total)

Martensite and bainite, particularly martensite, are important for achieving strength of a hot-stamped part. If the total of the area fraction of martensite and the area fraction of bainite is less than 95%, it is not possible to achieve sufficient strength, for example, a tensile strength of not less than 1180 MPa. Therefore, the area fraction of martensite and the area fraction of bainite are not less than 95% in total. Martensite may be, for example, either fresh martensite or tempered martensite. The tempered martensite obtained in the present embodiment is, for example, auto-tempered martensite. Fresh martensite is as-quenched martensite. Tempered martensite includes iron-based carbides which have precipitated after or during the cooling of tempering. Auto-tempered martensite is tempered martensite which is generated during cooling in quenching without being subjected to heat treatment for tempering. To achieve desired strength more surely, the area fraction of martensite is preferably more than the area fraction of bainite, and the area fraction of martensite is preferably not less than 70%.

The balance other than martensite and bainite is one or more of ferrite, pearlite, or retained austenite, for example. The amounts thereof are preferably as low as possible.

Identification of martensite, bainite, ferrite, pearlite, and retained austenite, confirmation of positions thereof, and measurement of area fractions thereof may be performed by observing a cross-section in parallel with the rolling direction and the thickness direction, or a cross-section orthogonal to the rolling direction of a hot-stamped part. Observation of a cross section may be performed by, for example, etching the cross-section with a Nital reagent, and observing it at a magnification of 1000 times to 100000 times with a scanning electron microscope (SEM) or a transmission electron microscope (TEM). Other etching solutions may be used in place of the Nital reagent. An example of usable etching solution is described in Japanese Laid-open Patent Publication No. 59-219473. The etching solution described in Japanese Laid-open Patent Publication No. 59-219473 is "a color etching solution characterized by consisting of a pretreatment solution and a post-treatment solution, in which the pretreatment solution is prepared by mixing a solution A in which 1 to 5 g of picric acid is dissolved into 100 mL of ethanol, with a solution B in which 1 to 25 g of sodium thiosulfate and 1 to 5 g of citric acid are dissolved into 100 mL of water, in a proportion of 1:1, and thereafter adding 1.5 to 4% of nitric acid to the solution, and the post-treatment solution is prepared by mixing 10% of the pretreating solution with a 2% Nital solution, or mixing 2 to 5% of nitric acid with 100 ml of ethanol." Crystal orientation analysis using a field emission scanning electron microscope (FE-SEM) may also be performed to identify structures, confirm positions thereof, and measure area fractions thereof. Structures may also be determined from hardness measurement of a minute region, such as measurement of micro Vickers hardness.

The area fractions of bainite and martensite may also be measured in the following way. For example, a sample is obtained which has a cross-section in parallel with the rolling direction and the thickness direction of a steel sheet as an observation surface, the observation surface is electropolished, and a portion of the steel sheet at a depth of ⅛ to ⅜ thickness thereof from the surface is observed with an FE-SEM. In such an occasion, each measurement is performed at a magnification of 5000 times in 10 visual fields, the area fraction is assumed to be an average value thereof. Observed martensite may include tempered martensite as well. Since martensite may not be sufficiently etched by Nital etching, the area fractions of ferrite and bainite may be measured by the above described method using an FE-SEM, and the area fraction of martensite may be assumed to be the area fraction of the un-etched portion which is observed by the FE-SEM. The area fraction of retained austenite may also be determined from intensity measurement by X-ray diffraction. For example, it may be determined from an X-ray diffraction intensity ratio between ferrite and austenite. Ferrite, which is made up of lump-like grains, means a structure which does not include any sub-structure such as a lath thereinside.

(Coverage Factor of Prior Austenite Grain Boundary by Iron-Based Carbides: Not More than 80%)

The coverage factor of prior austenite grain boundary by iron-based carbides means a ratio of portions at which iron-based carbides have precipitated within the prior austenite grain boundary. The portions of the prior austenite grain boundary where iron-based carbides have precipitated look like being covered with the iron-based carbides when observed with microscope. If the ratio of portions at which iron-based carbides have precipitated within the prior austenite grain boundary is more than 80%, intergranular fracture is more likely to occur, and therefore sufficient low-temperature toughness cannot be achieved. Therefore, the coverage factor is not more than 80%. To achieve further excellent low-temperature toughness, the coverage factor is preferably not more than 70%, and more preferably not more than 60%.

(Number Density of Iron-Based Carbides in Prior Austenite Grains: Not Less than 45/μm$^2$)

Iron-based carbides in prior austenite grains contribute to enhancement of low-temperature toughness. If the number density of iron-based carbides in prior austenite grains is less than 45/μm$^2$, it is not possible to achieve sufficient low-temperature toughness. Therefore, the number density is not less than 45/μm$^2$. In order to achieve more excellent low-temperature toughness, the number density is preferably not less than 50/μm$^2$. If the number density is more than 200/μm$^2$, the effect of enhancing low-temperature toughness is saturated. Therefore, the number density is preferably not more than 200/μm$^2$.

An Iron-based carbide is a compound consisting of iron and carbon, examples of which include cementite (θ phase), ε phase, and χ phase. As describe later, Si or the like may be dissolved into and contained in iron carbide. Carbides containing no iron, such as Ti carbides and Nb carbides, do not correspond to the iron-based carbide.

Here, a method of determining a coverage factor of prior austenite grain boundary by iron-based carbides will be described with reference to FIG. 1. FIG. 1 is a schematic diagram illustrating a prior austenite grain, and iron-based carbides that have precipitated at the grain boundary.

In the example illustrated in FIG. 1, a prior austenite grain 21 which has a hexagonal shape in an observation surface is included in a hot-stamped part. Iron-based carbides 1 and 2 precipitate at a first side 31, iron-based carbides 3 and 4 precipitate at a second side 32, iron-based carbides 5, 6 and 7 precipitate at a third side 33, an iron-based carbide 8 precipitates at a fourth side 34, iron-based carbides 9 and 10 precipitate at a fifth side 35, and iron-based carbides 11 and 12 precipitate at a sixth side 36. The length of the side 31 is $L_1$, the length of the side 32 is $L_2$, the length of the side 33 is $L_3$, the length of the side 34 is $L_4$, the length of the side 35 is $L_5$, and the length of the side 36 is $L_6$. The lengths of the iron-based carbides 1 and 2 on the grain boundary are $X_1$ and $X_2$, respectively; the lengths of the iron-based carbides 3 and 4 on the grain boundary are $X_3$ and $X_4$, respectively; the lengths of the iron-based carbides 5, 6 and 7 on the grain boundary are $X_5$, $X_6$ and $X_7$, respectively; the length of the iron-based carbide 8 on the grain boundary is $X_8$; the lengths of the iron-based carbides 9 and 10 on the grain boundary are $X_9$ and $X_{10}$, respectively; the lengths of the iron-based carbides 11 and 12 on the grain boundary are $X_{11}$ and $X_{12}$, respectively. Note that "the length of an iron-based carbide on a grain boundary" means a distance between two points of intersection between an iron-based carbide and a grain boundary in an observation surface.

Then, the sum L (μm) of the lengths of the six sides 31 to 36 is found, and the sum X (μm) of the lengths of the iron-based carbides 1 to 12 on the grain boundary is found to determine a value represented by "(X/L)×100" (%) as a coverage factor. Note that when determining a coverage factor in one hot-stamped part, coverage factors are determined for each of 10 or more prior austenite grains included in the hot-stamped part, and an average value thereof is assumed to be the coverage factor in the hot-stamped part. A prior austenite grain boundary is assumed to be a part which is caused to appear by an etching solution containing sodium dodecylbenzenesulfonate, and a prior austenite grain and iron-based carbides have precipitated at the grain boundary thereof are observed with an FE-SEM.

Although the prior austenite grain 21 which has a hexagonal shape in an observation surface is illustrated as an example in FIG. 1, in general, actual prior austenite grains have more complex shapes. Therefore, in practice, sides of a prior austenite grain are identified according to the shape of the observed prior austenite grain, and the sum of the lengths of each side is determined. When a curved portion is present in a grain boundary, the portion may be approximated to a plurality of sides.

Subsequently, the chemical composition of a hot-stamped part according to an embodiment of the present invention and a steel sheet used for manufacturing the hot-stamped part will be described. In the following description, the symbol "%", which is the unit of each element contained in a hot-stamped part and a steel sheet used for manufacturing the hot-stamped part, means, unless otherwise stated, "mass %". A hot-stamped part and a steel sheet used for manufacturing the hot-stamped part have a chemical composition represented by: C: 0.120% to 0.400%; Si: 0.005% to 2.000%; Mn or Cr, or both thereof: 1.00% to 3.00% in total; Al: 0.005% to 0.100%; B: 0.0003% to 0.0020%; P: not more than 0.030%; S: not more than 0.0100%; 0: not more than 0.0070%; N: not more than 0.0070%; Ti: 0% to 0.100%; Nb: 0% to 0.100%; V: 0% to 0.100%; Ni: 0% to 2.00%; Cu: 0% to 2.00%; Mo: 0% to 0.50%; Ca or REM (rare earth metal), or both thereof: 0% to 0.0300% in total; and the balance: Fe and impurities. As the impurities, those contained in raw materials such as ores and scraps, and those introduced in the production process are exemplified.

(C: 0.120% to 0.400%)

C (Carbon) is an element to enhance the strength of a hot-stamped part. When the C content is less than 0.120%, the effect by the above described function cannot be achieved sufficiently. For example, it is not possible to obtain a tensile strength of not less than 1180 MPa. Therefore, the C content is not less than 0.120%. To obtain more excellent strength, the C content is preferably not less than 0.140%, and more preferably not less than 0.150%. When the C content is more than 0.400%, the strength is excessive, and sufficient low-temperature toughness cannot be achieved. Further, it is also difficult to achieve sufficient weldability and workability. Therefore, the C content is not more than 0.400%. To obtain more excellent low-temperature toughness, the C content is preferably not more than 0.370%, and more preferably not more than 0.350%.

(Si: 0.005% to 2.000%)

Si (Silicon) is an element which dissolves into an iron-based oxide thereby enhancing hydrogen embrittlement resistance. Although detailed correlation between Si and the hydrogen embrittlement resistance is not clear, it is inferred that elastic strain at the interface between the iron-based carbide and the matrix phase increases as a result of Si dissolving into an iron-based carbide, and thereby hydrogen trapping capability of the iron-based carbide is enhanced. When the Si content is less than 0.005%, the effect by the above described function cannot be achieved sufficiently. Therefore, the Si content is not less than 0.005%. To obtain more excellent hydrogen embrittlement resistance, the Si content is preferably not less than 0.01%, and more preferably not less than 0.15%. When the Si content is more than 2.000%, the effect of enhancing the hydrogen embrittlement resistance is saturated, and Ac3 point is excessively high, thus unreasonably increasing heating temperature in hot stamp forming. Therefore, the Si content is not more than 2.000%. Considering the balance between the hydrogen embrittlement resistance and the Ac3 point, the Si content is preferably not more than 1.600%.

Si also affects platability and delayed fracture characteristic. For example, when the Si content is more than 0.005%, the platability deteriorates, thus resulting sometimes in unplating. For this reason, when a plated steel sheet is used as a steel sheet for hot stamping, the Si content is preferably not more than 0.500%. On the other hand, Si increases delayed fracture characteristic. Therefore, when a plated steel sheet is used as a steel sheet for hot stamping, the Si content is preferably not less than 0.500% to achieve excellent delayed fracture resistance.

(Mn or Cr, or Both Thereof: 1.00% to 3.00% in Total)

Mn (Manganese) and Cr (Chromium) are important elements for delaying ferrite transformation during cooling in hot stamp forming, and thereby obtaining a desired structure of a hot-stamped part to be described below. When the total of the Mn content and the Cr content is less than 1.00%, it is likely that ferrite and pearlite are formed during cooling in hot stamp forming, and a desired structure cannot be obtained. Thus, since the desired structure has not been obtained, it is not possible to achieve sufficient strength, for example, a tensile strength of not less than 1180 MPa. Therefore, the total of the Mn content and the Cr content is not less than 1.00%. To achieve more excellent strength, the total of the Mn content and the Cr content is preferably not less than 1.30%, and more preferably not less than 1.40%. When the total of the Mn content and the Cr content is more than 3.00%, the effect of delaying ferrite transformation and thereby increasing strength is saturated. Moreover, the strength of hot-rolled steel sheet excessively increases, and thereby, rupture sometimes occurs during cold rolling, and/or wear and failure of the blade to be used for cutting is sometimes pronounced. Therefore, the total of the Mn content and the Cr content is not more than 3.00%. Considering an appropriate range of strength, the total of the Mn and Cr contents is preferably not more than 2.9%, and more preferably not more than 2.8%. When Mn is excessively contained, embrittlement occurs caused by segregation of Mn, and thereby, a problem such as breakage of cast slab is more likely to occur, and also weldability is likely to deteriorate. Although the content of each of Mn and Cr is not particularly limited, the Mn content is not less than 0.8%, and the Cr content is not less than 0.2%, for example.

(Al: 0.005% to 0.100%)

Al (Aluminum) is an effective element for deoxidation. When the Al content is less than 0.005%, deoxidation is insufficient, and a large amount of oxides may remain in a hot-stamped part, particularly deteriorating local deformability. Moreover, the variations of features increase. Therefore, the Al content is not less than 0.005%. For sufficient deoxidation, the Al content is preferably not less than 0.006%, and more preferably not less than 0.007%. When the Al content is more than 0.100%, a large amount of oxides primarily consisting of alumina remains in a hot-stamped part, thereby deteriorating local deformability. Therefore, the Al content is not more than 0.100%. To suppress the remaining of alumina, the Al content is preferably not more than 0.08%, and more preferably not more than 0.075%.

(B: 0.0003% to 0.0020%)

B (Boron) is an element to increase hardenability of a steel sheet for hot stamping. As a result of increase of hardenability, it is easier to obtain martensite in the structure of a hot-stamped part. When the B content is less than 0.0003%, the effect by the above described function is not achieved sufficiently. To achieve more excellent hardenability, the B content is preferably not less than 0.0004%, and more preferably not less than 0.0005%. When the B content is more than 0.0020%, the effect of enhancing hardenability is saturated, and iron-based borides excessively precipitate, deteriorating hardenability. Therefore, the B content is not more than 0.0020%. To suppress the precipitation of iron-based borides, the B content is preferably not more than 0.0018%, and more preferably not more than 0.0017%.

(P: not more than 0.030%)

P (Phosphorus) is not an essential element, and contained in steel as an impurity, for example. P is an element that segregates in a middle portion in the thickness direction of the steel sheet, thereby embrittling a welded zone. For this reason, the P content is preferably as low as possible. Particularly, when the P content is more than 0.030%, embrittlement of welded zone is pronounced. Therefore, the P content is not more than 0.030%. The P content is preferably not more than 0.020%, and more preferably not more than 0.015%. Reducing the P content is costly, and reducing it to less than 0.001% raises the cost remarkably. For this reason, the P content may be not less than 0.001%.

(S: not more than 0.0100%)

S (Sulfur) is not an essential element and contained in steel as an impurity, for example. S is an element that hinders casting and hot rolling in manufacturing a steel sheet, thereby deteriorating weldability of a hot-stamped part. For this reason, the S content is preferably as low as possible. Particularly when the S content is more than 0.0100%, the adverse effects are pronounced. Therefore, the S content is not more than 0.0100%. The S content is preferably not more than 0.008%, and more preferably not more than 0.005%. Reducing the S content is costly, and reducing it to less than 0.0001% raises the cost remarkably. For this reason, the S content may be not less than 0.0001%.

(O: Not More than 0.0070%)

O (Oxygen) is not an essential element and contained in steel as an impurity, for example. O is an element that forms oxides, and thereby causes deterioration of properties of a steel sheet for hot stamping. For example, oxides that are in the vicinity of the surface of the steel sheet may cause a surface flaw, thereby deteriorating the appearance quality. If an oxide is in a cut surface, it forms a notch-shaped flaw on the cut surface, causing deterioration of properties of a hot-stamped part. For this reason, the O content is preferably as low as possible. Particularly, when the O content is more than 0.0070%, deterioration of properties is pronounced. Therefore, the O content is not more than 0.0070%. The O content is preferably not more than 0.0050%, and more preferably not more than 0.0040%. Reducing the O content is costly, and reducing it to less than 0.0001% raises the cost remarkably. For this reason, the O content may be not less than 0.0001%.

(N: Not More than 0.0070%)

N (Nitrogen) is not an essential element, and contained in steel as an impurity, for example. N is an element that forms coarse nitrides, thereby deteriorating bendability and hole expandability. N also causes occurrence of blow holes during welding. For this reason, the N content is preferably as low as possible. Particularly, when the N content is more than 0.0070%, deterioration of bendability and hole expandability is pronounced. Therefore, the N content is not more than 0.0070%. Reducing the N content is costly, and reducing it to less than 0.0005% raises the cost remarkably. For this reason, the N content may be not less than 0.0005%. Moreover, from the viewpoint of manufacturing cost, the N content may be not less than 0.0010%.

Ti, Nb, V, Ni, Cu, Mo, Ca, and REM are not essential elements, and optional elements that may be appropriately contained with a predetermined amount as a limit in a steel sheet for hot stamping, and in a hot-stamped part.

(Ti: 0% to 0.100%, Nb: 0% to 0.100%, V: 0% to 0.100%)

Ti, Nb, and V are elements that inhibit the crystal grain growth of the austenite phase during hot stamp forming and thus contribute to enhancements of strength and toughness through grain refinement strengthening of the transformed structure. Ti also has a function of combining with N to form TiN, thereby inhibiting B from forming a nitride. Therefore, one or any combination selected from the group consisting of these elements may be contained. However, when any of the Ti content, the Nb content, and the V content is more than 0.100%, Ti carbides, Nb carbides, or V carbides are excessively formed, resulting in deficiency in the amount of C, which contributes to strengthening of martensite, so that sufficient strength cannot be achieved. Therefore, all of the Ti content, the Nb content, and the V content are not more than 0.100%. Any of the Ti content, the Nb content, and the V content is preferably not more than 0.080%, and more preferably not more than 0.050%. To surely achieve the effect by the above described function, all of the Ti content, the Nb content, and the V content are preferably not less than 0.005%. That is, it is preferable that "Ti: 0.005% to 0.100%", "Nb: 0.005% to 0.100%", or "V: 0.005% to 0.100%", or any combination thereof be satisfied.

(Ni: 0% to 2.00%, Cu: 0% to 2.00%, Mo: 0% to 0.50%)

Ni, Cu, and Mo are elements that increase the hardenability of a steel sheet for hot stamping. As a result of increase in hardenability, it is more likely that martensite is formed in the structure of a hot-stamped part. Therefore, one or any combination selected from the group consisting of these elements may be contained. However, when either of the Ni content or the Cu content is more than 2.00%, or the Mo content is more than 0.50%, weldability and hot workability deteriorates. Therefore, both of the Ni content and the Cu content are not more than 2.00%, and the Mo content is not more than 0.50%. To surely achieve the effect of the above described function, any of the Ni content, the Cu content, and the Mo content is preferably not less than 0.01%. That is, it is preferable that "Ni: 0.05% to 2.00%", "Cu: 0.05% to 2.00%", or "Mo: 0.05% to 0.50%", or any combination thereof be satisfied.

(Ca or REM, or Both Thereof: 0% to 0.0300% in Total)

Ca and REM are elements that contribute to enhancement of strength, and improvement in toughness through structure. Therefore, Ca or REM or both thereof may be contained. However, when the total of the Ca content and the REM content are more than 0.0300%, castability and hot workability deteriorate. Therefore, the total of the Ca content and the REM content are not more than 0.0300%. To surely achieve the effect of the above described function, the total of the Ca content and the REM content are preferably not less than 0.0005%. That is, it is preferable that "Ca or REM, or both thereof: 0.0005% to 0.0300% in total" is satisfied. REM refers to elements that belong to Sc, Y, and elements belonged in lanthanoide series, and the "REM content" means the total content of these elements. Industrially, REM is often added as misch metal, and it contains multiple kinds of elements such as La and Ce. A metal element belonging to REM, such as metal La and metal Ce, may be added alone.

According to a hot-stamped part according to the present embodiment, it is possible to achieve excellent tensile strength and low-temperature toughness since it has an appropriate chemical composition and structure.

Subsequently, a method of manufacturing the hot-stamped part according to the embodiment of the present invention will be described. According to the method described herein, it is possible to manufacture the hot-stamped part according to the embodiment of the present invention.

In the manufacturing method, a steel sheet for hot stamping, which has the above described chemical composition, is heated to a temperature of not less than Ac3 point and not more than 950° C. at an average heating rate of not less than 2° C./sec; is then cooled through a temperature range from a Ar3 point to (Ms point−50)° C. at an average cooling rate of not less than 100° C./sec while performing hot pressing; and is further cooled through a temperature range from (Ms point−50)° C. to 100° C. at an average cooling rate of not more than 50° C./sec. The maximum cooling rate is not more than 70° C./sec and the minimum cooling rate is not less than 5° C./sec in the temperature range from (Ms point−120)° C. to 100° C.

(Heating Temperature: Not Less than Ac3 and not More than 950° C.)

The temperature to which the steel sheet for hot stamping is heated is not less than Ac3 and not more than 950° C. The steel sheet is caused to have a structure of an austenite single phase by heating the steel sheet to a temperature of not less than Ac3 point. It is possible to obtain a structure in which the area fraction of martensite and the area fraction of bainite are not less than 95%, thus obtaining a high strength, for example, a tensile strength of not less than 1180 MPa by subjecting the steel sheet having an austenite single phase structure to quenching. Since the structure of the steel sheet includes ferrite when the heating temperature is less than Ac3 point, even if such quenching of the steel sheet is performed, ferrite grows and it is not possible to obtain a tensile strength of not less than 1180 MPa. Therefore, the heating temperature is not less than Ac3 point. When the heating temperature is more than 950° C., austenite grains become coarse, and low-temperature toughness after quenching deteriorate. Therefore, the heating temperature is not more than 950° C.

The Ac3 point may be determined from the following formula.

$$\text{Ac3 point (° C.)}=910-203\sqrt{C}-30Mn-11Cr+44.7Si+400Al+700P-15.2Ni-20Cu+400Ti+104V+31.5Mo$$

(C, Mn, Cr, Si, Al, P, Ni, Cu, Ti, V, and Mo Each Represent a Content (Mass %) of Each Component in Steel Sheet.)

If Ni, Cu, Ti, V and/or Mo, which are optional elements, is not contained in the steel sheet, the content of any element which is not contained is supposed to be 0 (mass %).

(Average Heating Rate: Not Less than 2° C./Sec)

When the heating rate is less than 2° C./sec, austenite grains become coarse during heating, and sufficient low-temperature toughness and delayed fracture resistance cannot be achieved. Therefore, the average heating rate during heating to a temperature of not less than Ac3 point and not more than 950° C. is not less than 2° C./sec. To further inhibiting the coarsening of austenite grains, the average heating rate is preferably not less than 3° C./sec, and more preferably not less than 4° C./sec. Moreover, increasing the heating rate is also effective for increasing the productivity. The effects of the embodiment of the present invention can be achieved even without particularly setting an upper limit of the average heating rate. Therefore, the average heating rate may be appropriately set considering the capacity of the manufacturing facility such as heating apparatuses, without particularly setting an upper limit of the average heating rate. Here, an average heating rate is a value obtained by dividing a difference between a temperature at which heating is started and a heating temperature by a time period taken for the heating.

After being heated to a temperature of not less than Ac3 point and not more than 950° C. at an average heating rate of not less than 2° C./sec, the steel sheet is cooled while being subjected to hot pressing. That is, hot stamp forming is performed. Transformation and precipitation of iron-based carbides occur according to temperature during the cooling. Here, the relationship between temperature, and transformation and precipitation of iron-based carbides will be described.

In the beginning, in the temperature range from the heating temperature to the Ar3 point, transformation such as ferrite transformation, and precipitation of iron-based carbides do not occur. Therefore, the cooling rate in this temperature range does not affect the structure of a hot-stamped part. Once the temperature of the steel sheet reaches the Ar3 point, ferrite transformation and/or pearlite transformation may start depending on the cooling rate, and further once the temperature enters a temperature range lower than the Al point, iron-based carbides start precipitating. Therefore, the cooling rate in the temperature range of not more than the Ar3 point significantly affects the structure of a hot-stamped part. Iron-based carbides precipitate both at the grain boundary and in the prior austenite grain, and they are more likely to precipitate at grain boundary at a temperature of not less than (Ms point−50)° C., and in grain at a temperature of not more than (Ms point−50)° C. Therefore, it is important to change the average cooling rate with reference to a temperature of (Ms point−50)° C. The precipitation of iron-based oxides is very unlikely to occur at a temperature of less than 100° C., and the transformation does not occur at less than 100° C. Therefore, the cooling rate in this temperature range as well does not affect the structure of a hot-stamped part. Then, in the present embodiment, the cooling rate in a temperature range from the Ar3 point to (Ms point−50)° C., and the cooling rate in a temperature range from (Ms point−50)° C. to 100° C. are specified.

The Ar3 point (Ar3 transformation point) and Ms point may be found from the following formulas.

$$\text{Ar3 point (° C.)}=901-325C+33Si-92(Mn+Ni/2+Cr/2+Cu/2+Mo/2)$$

$$\text{Ms point (° C.)}=561-474C-33Mn-17Ni-17Cr-21Mo$$

(C, Si, Mn, Ni, Cr, Cu, and Mo each represent the content (mass %) of each component in steel sheet.)

If Ni, Cu, Ti, V and/or Mo, which are optional elements, is not contained in the steel sheet, the content of any element which is not contained is supposed to be 0 (mass %).

Since there is a correlation as described above between temperature, and transformation and precipitation of iron-based carbides, it is conceived that the cooling rate is controlled for each of the following four temperature ranges. The four temperature ranges include a first temperature range from the heating temperature to the Ar3 point, a second temperature range from the Ar3 point to (Ms point−50)° C., a third temperature range from (Ms point−50)° C. to 100° C., and a fourth temperature range of less than 100° C.

(First Temperature Range)

In the first temperature range (from the heating temperature to the Ar3 point), since neither transformation such as ferrite transformation, as described above, nor precipitation of iron-based carbides occur, there is no need of particularly controlling the cooling rate. However, considering that the average cooling rate in the second temperature range is not less than 100° C./sec as described later, it is preferable that the average cooling rate in the first temperature range is not less than 100° C./sec as well.

(Second Temperature Range)

In the second temperature range (from the Ar3 point to (Ms point−50)° C.), ferrite transformation and pearlite transformation occur depending on the cooling rate, and further iron-based carbides precipitate in the temperature range lower than the A1 point, as described above. If the average cooling rate in the second temperature range is not less than 100° C./sec, it is possible to avoid ferrite transformation and pearlite transformation, thereby making the total of the martensite area fraction and the bainite area fraction be not less than 95%. On the other hand, if the average cooling rate in the second temperature range is less than 100° C./sec, ferrite transformation and/or pearlite transformation occurs so that it is not possible to make the total of the martensite area fraction and the bainite area fraction be not less than 95%. Therefore, the average cooling rate in the second temperature range is not less than 100° C./sec. Moreover, in the second temperature range, iron-based carbides are likely to precipitate at a grain boundary and the coverage factor of grain boundary by the iron-based carbides increases as the cooling time period in the second temperature range increases. For this reason, to make the coverage factor be not more than 80%, the cooling time period in the second temperature range is preferably shorter. From this viewpoint as well, it is very effective to make the average cooling rate in the second temperature range be not less than 100° C./sec. To surely obtain a desired structure, the average cooling rate in the second temperature range is preferably not less than 150° C./sec, and more preferably not less than 200° C./sec. An upper limit of the average cooling rate in the second temperature range is not particularly specified, and in an industrial sense, a range of not more than 500° C./sec is practical. Here, the average cooling rate in the second temperature range is a value obtained by dividing the difference between the Ar3 point and (Ms point−50) by the time period taken for the cooling.

(Third Temperature Range)

In the third temperature range (from (Ms point−50)° C. to 100° C.), iron-based oxides are likely to precipitate in grains of prior austenite, as described above. Making iron-based carbides precipitate in grains allows to obtain excellent low-temperature toughness. When the average cooling rate in the third temperature range is more than 50° C./sec, precipitation in grains is deficient resulting in that a large amount of dissolved C remains in steel sheet, thereby deteriorating low-temperature toughness. Therefore, the average cooling rate in the third temperature range is not more than 50° C./sec. To surely obtain a desired structure, the average cooling rate in the third temperature range is preferably not more than 30° C./sec, and more preferably not more than 20° C./sec.

Even if the average cooling rate is not more than 50° C./sec, when the cooling rate in a temperature range from (Ms point−120)° C. to 100° C. in the third temperature range is more than 70° C./sec, precipitation in prior austenite grains is deficient, making it impossible to achieve sufficient low-temperature toughness. Therefore, the maximum cooling rate in the temperature range from (Ms point−120)° C. to 100° C. is not more than 70° C./sec. Moreover, even if the average cooling rate is not more than 50° C./sec, when the cooling rate in a temperature range from (Ms point−120)° C. to 100° C. in the third temperature range is less than 5° C./sec, ferrite excessively precipitates during cooling, and it is not possible to make the total of the martensite area fraction and the bainite area fraction be not less than 95%. Moreover, the iron-based carbides that precipitate at a grain boundary increase so that the coverage factor of grain boundary by iron-based oxides is more than 80%. Therefore, the minimum cooling rate in the temperature range from (Ms point−120)° C. to 100° C. is not less than 5° C./sec.

(Fourth Temperature Range)

In the fourth temperature range (less than 100° C.), since precipitation of iron-based carbides is very unlikely to occur, and also transformation does not occur, as described above, there is no need of particularly controlling the cooling rate.

Thus, it is possible to manufacture a hot-stamped part according to the present embodiment, which has excellent strength and low-temperature toughness.

According to the method of manufacturing the hot-stamped part according to the present embodiment, since appropriate temperature control is performed, it is possible to obtain a hot-stamped part having an appropriate structure, thereby achieving excellent tensile strength and low-temperature toughness.

Other conditions of hot stamp forming, such as a type of forming and a kind of die, may be appropriately selected within a range not impairing the effects of the present embodiment. For example, the type of forming may include bending, drawing, bulging, hole expanding, and flange forming. The kind of die may be appropriately selected depending on the type of forming.

The steel sheet for hot stamping may be a hot-rolled steel sheet or a cold-rolled steel sheet. An annealed hot-rolled steel sheet or annealed cold-rolled steel sheet, which is obtained by subjecting a hot-rolled steel sheet or cold-rolled steel sheet to annealing, may also be used as the steel sheet for hot stamping.

The steel sheet for hot stamping may be a surface treated steel sheet such as a plated steel sheet. That is, a steel sheet for hot stamping may be provided with a plating layer. The plating layer contributes to enhancement of corrosion resistance, for example. The plating layer may be an electroplating layer or a hot-dip plating layer. The electroplating layer is exemplified by an electrogalvanizing layer, and a Zn—Ni alloy electroplating layer. The hot-dip plating layer is exemplified by a hot-dip galvanizing layer, an alloyed hot-dip galvanizing layer, a hot-dip aluminum plating layer, a hot-dip Zn—Al alloy plating layer, a hot-dip Zn—Al—Mg alloy plating layer, and a hot-dip Zn—Al—Mg—Si alloy plating layer. The coating weight of the plating layer is not particularly limited, and may be, for example, a coating weight within a common range. A plating layer is provided on a heat treated steel material in the same way as a steel sheet for heat treatment.

Subsequently, an example of a method of manufacturing a steel sheet for hot stamping will be described. In the manufacturing method, casting, hot rolling, pickling, cold rolling, annealing, and plating treatment are performed to manufacture a plated steel sheet, for example.

In casting, a slab is cast from a molten steel having the above described chemical composition. As the slab, a continuous casting slab and a slab made by a thin slab caster may be used. A process such as a continuous casting-direct rolling (CC-DR) process, in which hot rolling is performed immediately after a slab is cast, may be applied.

The temperature of the slab before hot rolling (slab heating temperature) is preferably not more than 1300° C. If the slab heating temperature is excessively high, not only the productivity deteriorates, but also the manufacturing cost increases. Therefore, the slab heating temperature is preferably not more than 1250° C. When the slab heating temperature is less than 1050° C., the temperature is lowered in finish rolling, thereby causing the rolling load to increase. As a result, not only the rollability may deteriorate, but also shape defects may occur in the steel sheet. Therefore, the slab heating temperature is preferably not less than 1050° C.

The temperature of finish rolling (finish rolling temperature) in hot rolling is preferably not less than 850° C. When the finish rolling temperature is less than 850° C., the rolling load may increase, leading to that not only the rolling may be difficult, but also shape defects may occur in the steel sheet. An upper limit of the finish rolling temperature is not particularly specified, and the finish rolling is preferably performed at not more than 1000° C. This is because, when the finish rolling temperature is more than 1000° C., the slab heating temperature is excessively increased to obtain a temperature of more than 1000° C.

The temperature in coiling the hot-rolled steel sheet (coiling temperature) after the end of hot rolling is preferably not more than 700° C. When the coiling temperature is more than 700° C., a thick oxide may be formed on the surface of the hot-rolled steel sheet, deteriorating a pickling property thereof. When cold rolling is performed after the coiling, the coiling temperature is preferably not less than 600° C. This is because when the coiling temperature is less than 600° C., the strength of the hot-rolled steel sheet may excessively increase, thereby causing sheet rupture and shape defects during cold rolling. Rough-rolled sheets after rough rolling may be joined together during hot rolling to perform finish rolling in a continuous manner. Further, finish rolling may be performed after once coiling the rough-rolled sheet.

Oxides on the surface of the hot-rolled steel sheet are removed by pickling. Pickling is particularly important to improve the hot-dip platability on the occasion of manufacturing a hot-dip plated steel sheet, such as a hot-dip aluminum plated steel sheet, a hot-dip galvanized steel sheet, an alloyed hot-dip galvanized steel sheet, and the like. The number of times pickling is performed may be one or more times.

In the cold rolling, for example, a rolling reduction ratio is 30% to 90%. When the rolling reduction ratio is less than 30%, it may be difficult to keep the shape of the cold-rolled steel sheet flat. Moreover, it is sometimes difficult to achieve sufficient ductility after cold rolling. When the rolling reduction ratio is more than 90%, the rolling load excessively increases, making the cold rolling difficult. To achieve more excellent ductility, the rolling reduction ratio is preferably not less than 40%, and to achieve more excellent rollability, the rolling reduction ratio is preferably not more than 70%. The number of rolling passes in the cold rolling, and the rolling reduction ratio for each pass are not particularly limited.

Annealing is performed in, for example, a continuous annealing line or a box-type furnace. The condition of annealing is not particularly limited, and it is preferably of a level that allows the steel sheet strengthened by cold rolling to be appropriately softened. For example, the annealing temperature is preferably within a range of 550° C. to 850° C. By performing annealing within this temperature range, dislocations introduced during cold rolling are relieved by recovery, recrystallization, and/or phase transformation.

As the plating treatment, for example, a hot-dip plating treatment or an electroplating treatment is performed. The hot-dip plating treatment includes a hot-dip aluminum plating treatment, a hot-dip galvanizing treatment, an alloyed hot-dip aluminum plating treatment, and an alloyed hot-dip galvanizing treatment. According to the hot-dip plating treatment, it is possible to achieve such effects as inhibiting the formation of scale and enhancing corrosion resistance. To inhibit the formation of scale in a hot-stamped part, a thicker plating layer is more preferable. To form a thicker plating layer, a hot-dip galvanizing treatment is more preferable than an electroplating treatment. Ni, Cu, Cr, Co, Al, Si or Zn, or any combination thereof may be included in a plating layer formed by the plating treatment. Moreover, to improve plating adhesiveness, a plating layer of Ni, Cu, Co or Fe, or any combination thereof may be formed on the cold-rolled steel sheet before annealing.

Note that all of the above described embodiments merely show examples for practicing the present invention, and those should not be interpreted as liming the technical scope of the present invention. That is, the present invention can be practiced in various forms without departing from its technical concept or its principal features.

Examples

Subsequently, an example of the present invention will be described. The condition shown in the example indicates merely one condition which is adopted to confirm the feasibility and effect of the present invention, and the present invention will not be limited to the example of this one condition. The present invention can adopt various conditions as long as its objective is achieved without departing from the gist of the present invention.

In this experiment, slabs were cast using steels (steel types a to r and A to H) having chemical compositions listed in Table 1, and hot rolling was performed under the conditions listed in Tables 2 and 3. For some of the hot-rolled steel sheets, cold rolling was performed after hot rolling. For some of the cold-rolled steel sheets, plating treatment was performed by a continuous annealing facility or a continuous hot-dip plating facility after cold rolling. In this way, various steel sheets for hot stamping (a hot-rolled steel sheet, a cold-rolled steel sheet, a hot-dip galvanized steel sheet, an alloyed hot-dip galvanized steel sheet, or a hot-dip aluminum plated steel sheet) were prepared. Under a condition in which a hot-rolled steel sheet was used as the steel sheet for hot stamping, the thickness of the hot-rolled steel sheet was 1.6 mm. Under a condition in which a steel sheet other than the hot-rolled steel sheet was used as the steel sheet for hot stamping, the thickness of the hot-rolled steel sheet was 3.2 mm, the rolling reduction ratio of cold rolling was 50%, and the thickness of the cold-rolled steel sheet was 1.6 mm. Blanks in Table 1 indicate that the content of the corresponding element was less than a detection limit. An underline in Table 1, 2, or 3 indicates that the numerical value thereof was out of the scope of the present invention.

After a steel sheet for hot stamping was prepared, hot stamp forming was performed under the conditions listed in Tables 4 and 5 to obtain hot-stamped part. In Tables 4 and 5, the minimum cooling rate indicates a minimum value of the cooling rate in a temperature range from (Ms point−120)° C. to 100° C., and the maximum cooling rate indicates a maximum value of the cooling rate in the temperature range from (Ms point−120)° C. to 100° C. An underline in Tables 4 or 5 indicates that the numerical value thereof was out of the scope of the present invention.

Then, measurement of tensile property, observation of structure, and evaluation of low-temperature toughness for each hot-stamped part were performed.

In the measurement of tensile property, a tensile test specimen conforming to JIS Z 2201 was taken, and a tension test was performed in conformity to JIS Z 2241 to measure tensile strength. These results are listed in Tables 6 and 7. An underline in Table 6 or 7 indicates that the numerical value is out of a desired range in the present invention.

In the observation of structure, an area fraction of martensite, an area fraction of bainite, an area fraction of ferrite, and an area fraction of retained austenite, a coverage factor of prior austenite grain boundary by iron-based carbides and a number density of iron-based carbides in prior austenite grains were measured.

The area fraction of martensite, the area fraction of bainite, and the area fraction of ferrite were determined by taking a sample which had a cross-section in parallel with the rolling direction and the thickness direction of the hot-stamped part as an observation surface, polishing the observation surface, performing Nital etching, and observing a portion of the steel sheet at a depth of ⅛ to ⅜ thickness thereof with an FE-SEM. In the observation, area tractions of each structure were measured in 10 visual fields at a magnification of 5000 times for one hot-stamped part, and an average value thereof was adopted as the area fraction of each structure in the hot-stamped part. The area fraction of retained austenite was determined from an X-ray diffraction intensity ratio between ferrite and austenite. Pearlite was not observed.

The coverage factor of prior austenite grain boundary by iron-based carbides was obtained by the method described with reference to FIG. 1. That is, for each hot-stamped part, a value represented by "(X/L)×100" (%) was determined.

In the evaluation of low-temperature toughness, a Charpy impact test was performed at −120° C. Then, evaluation was made such that a result was graded as a pass (O) when it exhibited an absorption energy, which was obtained by converting a measured absorption energy to that of a specimen having a thickness of 10 mm, of not less than 50 J/cm$^2$ and a percent ductile fracture of not less than 50%, and was graded as a fail (X) when it did not satisfy either one or both of them.

As listed in Tables 6 and 7, in inventive examples, in which all the conditions were within the scope of the present invention, it was possible to achieve a tensile strength of not less than 1180 MPa and excellent low-temperature toughness. On the other hand, in comparative examples, in which any one or more kinds of conditions were out of the scope of the present invention, it was not possible to achieve a tensile strength of not less than 1180 MPa and/or excellent low-temperature toughness.

In conditions a-7, b-7, c-7, n-7, and q-7, since the heating temperature of hot stamping was too low, the area fractions of martensite and bainite were deficient so that the desired tensile strength was not achieved.

In conditions a-8, b-8, c-8, n-8, and q-8, since the average cooling rate in the second temperature range was too low, the area fractions of martensite and bainite were deficient so that the desired tensile strength was not achieved. Moreover, the coverage factor by iron-based carbides increased so that excellent low-temperature toughness was not achieved.

In conditions a-9, b-9, c-9, n-9, and q-9, since the minimum cooling rate in the temperature range from (Ms point−120)° C. was low, the area fractions of martensite and bainite were deficient in the hot-stamped part so that the desired tensile strength was not achieved. Moreover, the coverage factor by iron-based carbides increased so that excellent low-temperature toughness was not achieved.

In conditions a-10, b-10, c-10, n-10, and q-10, since the maximum cooling rate in a temperature range from (Ms point−120)° C. to 100° C. in hot stamping was too high, precipitation of iron-based carbides in grains of prior austenite was deficient so that excellent low-temperature toughness was not achieved.

In conditions a-11, b-11, c-11, n-11, and q-11, since the average cooling rate in a third temperature range in hot stamping was too high, precipitation of iron-based carbides in grains of prior austenite was deficient so that excellent low-temperature toughness was not achieved.

In conditions A-1, B-1, C-1, D-1, E-1, F-1, G-1, and H-1, since the chemical compositions were out of the scope of the present invention, a tensile strength of not less than 1180 MPa and/or excellent low-temperature toughness were/was not achieved. For example, in condition B-1, the C content was too high so that the strength was excessively high and excellent low-temperature toughness was not achieved. In condition F-1, since the total of the Mn content and the Cr content were too high, excellent low-temperature toughness was not achieved.

TABLE 1

| STEEL | CHEMICAL COMPOSITION (MASS %) | | | | | | | | | | | | |
|---|---|---|---|---|---|---|---|---|---|---|---|---|---|
| TYPE | C | Si | Al | Mn | Cr | B | P | S | N | O | Ti | Nb | V |
| a | 0.128 | 0.010 | 0.011 | 1.22 | 0.21 | 0.0005 | 0.004 | 0.0011 | 0.0026 | 0.0012 | | | |
| b | 0.149 | 0.180 | 0.013 | 2.69 | 0.22 | 0.0009 | 0.007 | 0.0014 | 0.0028 | 0.0011 | | | |
| c | 0.231 | 0.280 | 0.015 | 1.32 | 0.19 | 0.0007 | 0.005 | 0.0015 | 0.0033 | 0.0009 | | | |
| d | 0.229 | 0.180 | 0.029 | 1.25 | 1.38 | 0.0039 | 0.019 | 0.0033 | 0.0045 | 0.0024 | | | |
| e | 0.242 | 1.150 | 0.075 | 2.49 | 0.33 | 0.0004 | 0.011 | 0.0023 | 0.0025 | 0.0008 | 0.029 | | |
| f | 0.229 | 0.130 | 0.033 | 1.56 | 0.17 | 0.0008 | 0.009 | 0.0038 | 0.0030 | 0.0012 | | 0.059 | |
| g | 0.235 | 0.110 | 0.029 | 1.25 | 0.20 | 0.0009 | 0.013 | 0.0027 | 0.0024 | 0.0018 | | | 0.056 |
| h | 0.246 | 0.250 | 0.015 | 1.49 | 0.42 | 0.0008 | 0.010 | 0.0024 | 0.0020 | 0.0010 | 0.019 | 0.011 | |
| i | 0.229 | 0.030 | 0.006 | 1.29 | 0.20 | 0.0010 | 0.012 | 0.0029 | 0.0029 | 0.0013 | | | |
| j | 0.228 | 0.220 | 0.028 | 1.35 | 0.20 | 0.0016 | 0.009 | 0.0030 | 0.0025 | 0.0014 | | | |
| k | 0.233 | 0.060 | 0.033 | 1.35 | 0.21 | 0.0008 | 0.008 | 0.0022 | 0.0024 | 0.0009 | | | |
| l | 0.230 | 0.320 | 0.014 | 1.65 | 0.18 | 0.0012 | 0.014 | 0.0027 | 0.0040 | 0.0010 | | | |
| m | 0.229 | 0.480 | 0.039 | 2.02 | 0.85 | 0.0021 | 0.012 | 0.0038 | 0.0029 | 0.0013 | | | |
| n | 0.282 | 1.570 | 0.005 | 1.46 | 0.25 | 0.0019 | 0.008 | 0.0015 | 0.0024 | 0.0019 | | | |
| o | 0.284 | 0.380 | 0.007 | 1.88 | 0.22 | 0.0004 | 0.009 | 0.0019 | 0.0016 | 0.0007 | 0.024 | 0.014 | |
| p | 0.279 | 0.180 | 0.014 | 1.24 | 0.68 | 0.0008 | 0.001 | 0.0022 | 0.0029 | 0.0014 | | | 0.024 |
| q | 0.332 | 0.320 | 0.042 | 1.42 | 0.69 | 0.0009 | 0.006 | 0.0009 | 0.0021 | 0.0009 | | | |
| r | 0.388 | 0.480 | 0.032 | 1.68 | 0.18 | 0.0007 | 0.009 | 0.0019 | 0.0025 | 0.0011 | 0.058 | | 0.029 |
| A | 0.078 | 0.320 | 0.032 | 1.13 | 0.19 | 0.0007 | 0.012 | 0.0038 | 0.0030 | 0.0024 | | | |
| B | 0.607 | 0.410 | 0.024 | 1.32 | 0.22 | 0.0004 | 0.008 | 0.0021 | 0.0024 | 0.0016 | | | |
| C | 0.253 | 2.080 | 0.211 | 1.22 | 0.32 | 0.0011 | 0.010 | 0.0023 | 0.0032 | 0.0022 | | | |
| D | 0.233 | 0.330 | 0.112 | 1.29 | 0.55 | 0.0024 | 0.008 | 0.0019 | 0.0024 | 0.0010 | | | |
| E | 0.155 | 0.480 | 0.045 | 0.45 | 0.12 | 0.0016 | 0.006 | 0.0024 | 0.0027 | 0.0008 | | | |
| F | 0.234 | 0.510 | 0.032 | 2.45 | 1.68 | 0.0008 | 0.022 | 0.0026 | 0.0026 | 0.0023 | | | |
| G | 0.229 | 0.880 | 0.028 | 0.84 | 0.40 | 0.0000 | 0.021 | 0.0028 | 0.0031 | 0.0016 | | | |
| H | 0.232 | 0.420 | 0.012 | 1.36 | 0.20 | 0.0007 | 0.092 | 0.0020 | 0.0019 | 0.0024 | | | |

TABLE 1-continued

| STEEL TYPE | CHEMICAL COMPOSITION (MASS %) Ni | Cr | Mo | Ca | FEM | Ax3 (° C.) | Ax3 (° C.) | Ms (° C.) | REMARKS |
|---|---|---|---|---|---|---|---|---|---|
| a | | | | | | 806 | 738 | 456 | INVENTIVE EXAMPLE |
| b | | | | | | 767 | 601 | 398 | INVENTIVE EXAMPLE |
| c | | | | | | 793 | 705 | 405 | INVENTIVE EXAMPLE |
| d | | | | | | 793 | 654 | 388 | INVENTIVE EXAMPLE |
| e | | | | | | 833 | 616 | 359 | INVENTIVE EXAMPLE |
| f | | | | | | 789 | 680 | 398 | INVENTIVE EXAMPLE |
| g | | | | | | 803 | 704 | 405 | INVENTIVE EXAMPLE |
| h | | | | | | 792 | 673 | 388 | INVENTIVE EXAMPLE |
| i | 0.29 | | | | | 780 | 686 | 402 | INVENTIVE EXAMPLE |
| j | | 0.32 | | | | 791 | 686 | 405 | INVENTIVE EXAMPLE |
| k | | | 0.42 | | | 804 | 674 | 394 | INVENTIVE EXAMPLE |
| l | | | | 0.0045 | | 791 | 677 | 394 | INVENTIVE EXAMPLE |
| m | | | | | 0.0029 | 788 | 617 | 371 | INVENTIVE EXAMPLE |
| n | | | | | | 833 | 715 | 375 | INVENTIVE EXAMPLE |
| o | | | | | | 779 | 638 | 361 | INVENTIVE EXAMPLE |
| p | | | 0.22 | | | 782 | 661 | 372 | INVENTIVE EXAMPLE |
| q | | | | | | 778 | 641 | 345 | INVENTIVE EXAMPLE |
| r | | | 0.31 | | | 808 | 614 | 312 | INVENTIVE EXAMPLE |
| A | | | | | | 853 | 774 | 484 | COMPARATIVE EXAMPLE |
| B | | | | | | 743 | 586 | 226 | COMPARATIVE EXAMPLE |
| C | | | | | | 952 | 760 | 395 | COMPARATIVE EXAMPLE |
| D | | | | | | 832 | 692 | 399 | COMPARATIVE EXAMPLE |
| E | | | | | | 859 | 820 | 471 | COMPARATIVE EXAMPLE |
| F | | | | | | 771 | 539 | 341 | COMPARATIVE EXAMPLE |
| G | | | | | | 848 | 760 | 418 | COMPARATIVE EXAMPLE |
| H | | | | | | 857 | 705 | 403 | COMPARATIVE EXAMPLE |

TABLE 2

| CONDITION | STEEL TYPE | TYPE OF STEEL SHEET FOR HOT STAMPING | HOT-ROLLING SLAB HEATING TEMPERATURE (° C.) | FINISH TEMPERATURE (° C.) | COILING TEMPERATURE (° C.) | REMARKS |
|---|---|---|---|---|---|---|
| a-1 | a | HOT-ROLLED STEEL SHEET | 1220 | 870 | 440 | INVENTIVE EXAMPLE |
| a-2 | a | COLD-ROLLED STEEL SHEET | 1250 | 890 | 550 | INVENTIVE EXAMPLE |
| a-3 | a | HOT-DIP GALVANIZED STEEL SHEET | 1240 | 920 | 600 | INVENTIVE EXAMPLE |
| a-4 | a | ALLOYED HOT-DIP GALVANIZED STEEL SHEET | 1230 | 880 | 620 | INVENTIVE EXAMPLE |
| a-5 | a | HOT-DIP ALUMINUM PLATED STEEL SHEET | 1220 | 900 | 590 | INVENTIVE EXAMPLE |
| a-6 | a | HOT-DIP ALUMINUM PLATED STEEL SHEET | 1220 | 930 | 600 | INVENTIVE EXAMPLE |
| a-7 | a | HOT-DIP ALUMINUM PLATED STEEL SHEET | 1210 | 910 | 600 | COMPARATIVE EXAMPLE |
| a-8 | a | HOT-DIP ALUMINUM PLATED STEEL SHEET | 1190 | 900 | 620 | COMPARATIVE EXAMPLE |
| a-9 | a | COLD-ROLLED STEEL SHEET | 1250 | 880 | 600 | COMPARATIVE EXAMPLE |
| a-10 | a | HOT-DIP ALUMINUM PLATED STEEL SHEET | 1180 | 900 | 570 | COMPARATIVE EXAMPLE |
| a-11 | a | HOT-DIP ALUMINUM PLATED STEEL SHEET | 1200 | 900 | 600 | COMPARATIVE EXAMPLE |
| b-1 | b | HOT-ROLLED STEEL SHEET | 1210 | 940 | 520 | INVENTIVE EXAMPLE |
| b-2 | b | COLD-ROLLED STEEL SHEET | 1200 | 890 | 590 | INVENTIVE EXAMPLE |
| b-3 | b | HOT-DIP GALVANIZED STEEL SHEET | 1200 | 930 | 600 | INVENTIVE EXAMPLE |
| b-4 | b | ALLOYED HOT-DIP GALVANIZED STEEL SHEET | 1220 | 900 | 620 | INVENTIVE EXAMPLE |
| b-5 | b | HOT-DIP GALVANIZED STEEL SHEET | 1230 | 910 | 580 | INVENTIVE EXAMPLE |
| b-6 | b | HOT-DIP GALVANIZED STEEL SHEET | 1240 | 930 | 610 | INVENTIVE EXAMPLE |
| b-7 | b | HOT-DIP GALVANIZED STEEL SHEET | 1200 | 910 | 590 | COMPARATIVE EXAMPLE |

TABLE 2-continued

| CONDITION | STEEL TYPE | TYPE OF STEEL SHEET FOR HOT STAMPING | HOT-ROLLING SLAB HEATING TEMPERATURE (° C.) | HOT-ROLLING FINISH TEMPERATURE (° C.) | HOT-ROLLING COILING TEMPERATURE (° C.) | REMARKS |
|---|---|---|---|---|---|---|
| b-8 | b | HOT-DIP GALVANIZED STEEL SHEET | 1200 | 920 | 630 | COMPARATIVE EXAMPLE |
| b-9 | b | COLD-ROLLED STEEL SHEET | 1250 | 880 | 600 | COMPARATIVE EXAMPLE |
| b-10 | b | HOT-DIP ALUMINUM PLATED STEEL SHEET | 1180 | 900 | 570 | COMPARATIVE EXAMPLE |
| b-11 | b | HOT-DIP ALUMINUM PLATED STEEL SHEET | 1200 | 900 | 600 | COMPARATIVE EXAMPLE |
| c-1 | c | HOT-ROLLED STEEL SHEET | 1230 | 900 | 600 | INVENTIVE EXAMPLE |
| c-2 | c | COLD-ROLLED STEEL SHEET | 1200 | 910 | 590 | INVENTIVE EXAMPLE |
| c-3 | c | HOT-DIP GALVANIZED STEEL SHEET | 1210 | 920 | 600 | INVENTIVE EXAMPLE |
| c-4 | c | ALLOYED HOT-DIP GALVANIZED STEEL SHEET | 1200 | 900 | 610 | INVENTIVE EXAMPLE |
| c-5 | c | HOT-DIP GALVANIZED STEEL SHEET | 1180 | 900 | 620 | INVENTIVE EXAMPLE |
| c-6 | c | HOT-DIP GALVANIZED STEEL SHEET | 1230 | 930 | 600 | INVENTIVE EXAMPLE |
| c-7 | c | HOT-DIP GALVANIZED STEEL SHEET | 1270 | 830 | 590 | COMPARATIVE EXAMPLE |
| c-8 | c | HOT-DIP GALVANIZED STEEL SHEET | 1200 | 910 | 580 | COMPARATIVE EXAMPLE |
| c-9 | c | COLD-ROLLED STEEL SHEET | 1200 | 880 | 600 | COMPARATIVE EXAMPLE |
| c-10 | c | HOT-DIP ALUMINUM PLATED STEEL SHEET | 1200 | 900 | 570 | COMPARATIVE EXAMPLE |
| c-11 | c | HOT-DIP ALUMINUM PLATED STEEL SHEET | 1200 | 900 | 600 | COMPARATIVE EXAMPLE |
| d-1 | d | COLD-ROLLED STEEL SHEET | 1220 | 870 | 620 | INVENTIVE EXAMPLE |
| d-2 | d | HOT-DIP GALVANIZED STEEL SHEET | 1230 | 950 | 800 | INVENTIVE EXAMPLE |
| e-1 | e | COLD-ROLLED STEEL SHEET | 1270 | 970 | 630 | INVENTIVE EXAMPLE |
| f-1 | f | COLD-ROLLED STEEL SHEET | 1260 | 950 | 600 | INVENTIVE EXAMPLE |
| g-1 | g | COLD-ROLLED STEEL SHEET | 1260 | 980 | 600 | INVENTIVE EXAMPLE |
| h-1 | h | COLD-ROLLED STEEL SHEET | 1280 | 960 | 590 | INVENTIVE EXAMPLE |
| i-1 | i | COLD-ROLLED STEEL SHEET | 1230 | 910 | 610 | INVENTIVE EXAMPLE |

TABLE 3

| CONDITION | STEEL TYPE | TYPE OF STEEL SHEET FOR HOT STAMPING | HOT-ROLLING SLAB HEATING TEMPERATURE (° C.) | HOT-ROLLING FINISH TEMPERATURE (° C.) | HOT-ROLLING COILING TEMPERATURE (° C.) | REMARKS |
|---|---|---|---|---|---|---|
| j-1 | j | COLD-ROLLED STEEL SHEET | 1200 | 900 | 580 | INVENTIVE EXAMPLE |
| k-1 | k | COLD-ROLLED STEEL SHEET | 1200 | 930 | 600 | INVENTIVE EXAMPLE |
| l-1 | l | COLD-ROLLED STEEL SHEET | 1210 | 940 | 600 | INVENTIVE EXAMPLE |
| m-1 | m | COLD-ROLLED STEEL SHEET | 1230 | 920 | 590 | INVENTIVE EXAMPLE |
| n-1 | n | HOT-ROLLED STEEL SHEET | 1220 | 910 | 630 | INVENTIVE EXAMPLE |
| n-2 | n | COLD-ROLLED STEEL SHEET | 1240 | 920 | 650 | INVENTIVE EXAMPLE |
| n-3 | n | HOT-DIP GALVANIZED STEEL SHEET | 1210 | 920 | 650 | INVENTIVE EXAMPLE |
| n-4 | n | ALLOYED HOT-DIP GALVANIZED STEEL SHEET | 1200 | 890 | 630 | INVENTIVE EXAMPLE |
| n-5 | n | HOT-DIP GALVANIZED STEEL SHEET | 1220 | 900 | 580 | INVENTIVE EXAMPLE |

TABLE 3-continued

| CONDITION | STEEL TYPE | TYPE OF STEEL SHEET FOR HOT STAMPING | HOT-ROLLING SLAB HEATING TEMPERATURE (° C.) | HOT-ROLLING FINISH TEMPERATURE (° C.) | HOT-ROLLING COILING TEMPERATURE (° C.) | REMARKS |
|---|---|---|---|---|---|---|
| n-6 | n | HOT-DIP GALVANIZED STEEL SHEET | 1230 | 920 | 570 | INVENTIVE EXAMPLE |
| n-7 | n | HOT-DIP GALVANIZED STEEL SHEET | 1240 | 930 | 600 | COMPARATIVE EXAMPLE |
| n-8 | n | HOT-DIP GALVANIZED STEEL SHEET | 1200 | 930 | 620 | COMPARATIVE EXAMPLE |
| n-9 | n | COLD-ROLLED STEEL SHEET | 1250 | 880 | 600 | COMPARATIVE EXAMPLE |
| n-10 | n | HOT-DIP ALUMINUM PLATED STEEL SHEET | 1180 | 900 | 570 | COMPARATIVE EXAMPLE |
| n-11 | n | HOT-DIP ALUMINUM PLATED STEEL SHEET | 1200 | 900 | 600 | COMPARATIVE EXAMPLE |
| o-1 | o | HOT-DIP GALVANIZED STEEL SHEET | 1270 | 960 | 590 | INVENTIVE EXAMPLE |
| p-1 | p | HOT-DIP GALVANIZED STEEL SHEET | 1250 | 940 | 650 | INVENTIVE EXAMPLE |
| q-1 | q | HOT-ROLLED STEEL SHEET | 1180 | 880 | 470 | INVENTIVE EXAMPLE |
| q-2 | q | COLD-ROLLED STEEL SHEET | 1210 | 900 | 590 | INVENTIVE EXAMPLE |
| q-3 | q | HOT-DIP GALVANIZED STEEL SHEET | 1230 | 920 | 590 | INVENTIVE EXAMPLE |
| q-4 | q | ALLOYED HOT-DIP GALVANIZED STEEL SHEET | 1220 | 910 | 620 | INVENTIVE EXAMPLE |
| q-5 | q | HOT-DIP GALVANIZED STEEL SHEET | 1220 | 910 | 630 | INVENTIVE EXAMPLE |
| q-6 | q | HOT-DIP GALVANIZED STEEL SHEET | 1230 | 890 | 630 | INVENTIVE EXAMPLE |
| q-7 | q | HOT-DIP GALVANIZED STEEL SHEET | 1230 | 920 | 640 | COMPARATIVE EXAMPLE |
| q-8 | q | HOT-DIP GALVANIZED STEEL SHEET | 1210 | 930 | 600 | COMPARATIVE EXAMPLE |
| q-9 | q | COLD-ROLLED STEEL SHEET | 1250 | 880 | 600 | COMPARATIVE EXAMPLE |
| q-10 | q | HOT-DIP ALUMINUM PLATED STEEL SHEET | 1180 | 900 | 570 | COMPARATIVE EXAMPLE |
| q-11 | q | HOT-DIP ALUMINUM PLATED STEEL SHEET | 1200 | 900 | 600 | COMPARATIVE EXAMPLE |
| r-1 | r | HOT-DIP ALUMINUM PLATED STEEL SHEET | 1280 | 920 | 620 | INVENTIVE EXAMPLE |
| A-1 | A | COLD-ROLLED STEEL SHEET | 1230 | 920 | 630 | COMPARATIVE EXAMPLE |
| B-1 | B | COLD-ROLLED STEEL SHEET | 1210 | 930 | 620 | COMPARATIVE EXAMPLE |
| C-1 | C | COLD-ROLLED STEEL SHEET | 1240 | 940 | 590 | COMPARATIVE EXAMPLE |
| D-1 | D | COLD-ROLLED STEEL SHEET | 1230 | 900 | 600 | COMPARATIVE EXAMPLE |
| E-1 | E | COLD-ROLLED STEEL SHEET | 1200 | 910 | 600 | COMPARATIVE EXAMPLE |
| F-1 | F | COLD-ROLLED STEEL SHEET | 1210 | 920 | 620 | COMPARATIVE EXAMPLE |
| G-1 | G | COLD-ROLLED STEEL SHEET | 1210 | 930 | 630 | COMPARATIVE EXAMPLE |
| H-1 | H | COLD-ROLLED STEEL SHEET | 1230 | 920 | 640 | COMPARATIVE EXAMPLE |

TABLE 4

| CONDITION | HOT-PRESSING HEATING RATE (° C./SEC) | HEATING TEMPERATURE (° C.) | AVERAGE COOLING RATE IN SECOND TEMPERATURE RANGE (° C./SEC) | AVERAGE COOLING RATE IN THIRD TEMPERATURE RANGE (° C./SEC) | MINIMUM COOLING RATE (° C./SEC) | MAXIMUM COOLING RATE (° C./SEC) | REMARKS |
|---|---|---|---|---|---|---|---|
| a-1 | 6 | 910 | 160 | 35 | 10 | 60 | INVENTIVE EXAMPLE |
| a-2 | 4 | 930 | 120 | 30 | 5 | 50 | INVENTIVE EXAMPLE |
| a-3 | 5 | 920 | 240 | 50 | 10 | 50 | INVENTIVE EXAMPLE |
| a-4 | 10 | 920 | 160 | 45 | 20 | 70 | INVENTIVE EXAMPLE |
| a-5 | 6 | 900 | 110 | 45 | 10 | 60 | INVENTIVE EXAMPLE |
| a-6 | 7 | 920 | 220 | 50 | 5 | 70 | INVENTIVE EXAMPLE |
| a-7 | 5 | 740 | 160 | 40 | 30 | 60 | COMPARATIVE EXAMPLE |
| a-8 | 6 | 890 | 80 | 40 | 10 | 60 | COMPARATIVE EXAMPLE |
| a-9 | 10 | 900 | 100 | 50 | 3 | 60 | COMPARATIVE EXAMPLE |
| a-10 | 5 | 900 | 150 | 50 | 5 | 80 | COMPARATIVE EXAMPLE |
| a-11 | 5 | 900 | 120 | 55 | 10 | 60 | COMPARATIVE EXAMPLE |
| b-1 | 5 | 880 | 200 | 35 | 10 | 60 | INVENTIVE EXAMPLE |
| b-2 | 6 | 890 | 180 | 30 | 5 | 50 | INVENTIVE EXAMPLE |
| b-3 | 8 | 870 | 180 | 50 | 10 | 50 | INVENTIVE EXAMPLE |
| b-4 | 4 | 890 | 160 | 45 | 20 | 70 | INVENTIVE EXAMPLE |
| b-5 | 5 | 880 | 200 | 45 | 10 | 60 | INVENTIVE EXAMPLE |
| b-6 | 12 | 920 | 230 | 50 | 5 | 70 | INVENTIVE EXAMPLE |
| b-7 | 6 | 700 | 160 | 40 | 30 | 60 | COMPARATIVE EXAMPLE |
| b-8 | 7 | 900 | 60 | 40 | 10 | 60 | COMPARATIVE EXAMPLE |
| b-9 | 10 | 900 | 100 | 50 | 3 | 60 | COMPARATIVE EXAMPLE |
| b-10 | 5 | 900 | 150 | 50 | 5 | 80 | COMPARATIVE EXAMPLE |
| b-11 | 5 | 900 | 120 | 55 | 10 | 60 | COMPARATIVE EXAMPLE |
| c-1 | 8 | 920 | 180 | 20 | 10 | 60 | INVENTIVE EXAMPLE |
| c-2 | 4 | 930 | 160 | 50 | 5 | 50 | INVENTIVE EXAMPLE |
| c-3 | 6 | 900 | 160 | 45 | 10 | 50 | INVENTIVE EXAMPLE |
| c-4 | 5 | 940 | 150 | 40 | 20 | 70 | INVENTIVE EXAMPLE |
| c-5 | 3 | 930 | 180 | 50 | 10 | 60 | INVENTIVE EXAMPLE |
| c-6 | 9 | 900 | 230 | 30 | 5 | 70 | INVENTIVE EXAMPLE |
| c-7 | 5 | 720 | 120 | 30 | 30 | 60 | COMPARATIVE EXAMPLE |
| c-8 | 6 | 910 | 40 | 25 | 10 | 60 | COMPARATIVE EXAMPLE |
| c-9 | 10 | 900 | 100 | 50 | 2 | 60 | COMPARATIVE EXAMPLE |
| c-10 | 5 | 900 | 150 | 50 | 5 | 100 | COMPARATIVE EXAMPLE |
| c-11 | 5 | 900 | 120 | 55 | 10 | 60 | COMPARATIVE EXAMPLE |
| d-1 | 5 | 910 | 120 | 30 | 10 | 60 | INVENTIVE EXAMPLE |
| d-2 | 6 | 940 | 220 | 40 | 10 | 50 | INVENTIVE EXAMPLE |
| e-1 | 5 | 950 | 150 | 35 | 5 | 70 | INVENTIVE EXAMPLE |
| f-1 | 6 | 920 | 140 | 30 | 5 | 60 | INVENTIVE EXAMPLE |
| g-1 | 12 | 920 | 150 | 35 | 20 | 50 | INVENTIVE EXAMPLE |
| h-1 | 6 | 930 | 150 | 30 | 20 | 60 | INVENTIVE EXAMPLE |
| i-1 | 4 | 920 | 160 | 30 | 5 | 70 | INVENTIVE EXAMPLE |

TABLE 5

| CONDITION | HOT-PRESSING HEATING RATE (° C./SEC) | HEATING TEMPERATURE (° C.) | AVERAGE COOLING RATE IN SECOND TEMPERATURE RANGE (° C./SEC) | AVERAGE COOLING RATE IN THIRD TEMPERATURE RANGE (° C./SEC) | MINIMUM COOLING RATE (° C./SEC) | MAXIMUM COOLING RATE (° C./SEC) | REMARKS |
|---|---|---|---|---|---|---|---|
| i-1 | 4 | 920 | 160 | 30 | 10 | 50 | INVENTIVE EXAMPLE |
| j-1 | 5 | 910 | 160 | 30 | 5 | 70 | INVENTIVE EXAMPLE |
| k-1 | 6 | 920 | 150 | 35 | 15 | 60 | INVENTIVE EXAMPLE |
| l-1 | 8 | 910 | 150 | 30 | 10 | 60 | INVENTIVE EXAMPLE |
| m-1 | 4 | 930 | 160 | 10 | 10 | 70 | INVENTIVE EXAMPLE |
| n-1 | 5 | 900 | 120 | 20 | 10 | 60 | INVENTIVE EXAMPLE |
| n-2 | 6 | 920 | 150 | 40 | 5 | 50 | INVENTIVE EXAMPLE |
| n-3 | 7 | 920 | 150 | 40 | 10 | 50 | INVENTIVE EXAMPLE |
| n-4 | 10 | 910 | 140 | 35 | 20 | 70 | INVENTIVE EXAMPLE |
| n-5 | 5 | 910 | 160 | 30 | 30 | 60 | INVENTIVE EXAMPLE |
| n-6 | 5 | 930 | 220 | 40 | 10 | 60 | INVENTIVE EXAMPLE |
| n-7 | 6 | 710 | 110 | 30 | 30 | 60 | COMPARATIVE EXAMPLE |
| n-8 | 7 | 930 | 50 | 30 | 10 | 60 | COMPARATIVE EXAMPLE |
| n-9 | 10 | 900 | 100 | 50 | 3 | 60 | COMPARATIVE EXAMPLE |
| n-10 | 5 | 900 | 150 | 50 | 5 | 120 | COMPARATIVE EXAMPLE |
| n-11 | 5 | 900 | 120 | 55 | 10 | 60 | COMPARATIVE EXAMPLE |

TABLE 5-continued

| CONDITION | HOT-PRESSING HEATING RATE (° C./SEC) | HEATING TEMPERATURE (° C.) | AVERAGE COOLING RATE IN SECOND TEMPERATURE RANGE (° C./SEC) | AVERAGE COOLING RATE IN THIRD TEMPERATURE RANGE (° C./SEC) | MINIMUM COOLING RATE (° C./SEC) | MAXIMUM COOLING RATE (° C./SEC) | REMARKS |
|---|---|---|---|---|---|---|---|
| o-1 | 5 | 920 | 140 | 10 | 10 | 60 | INVENTIVE EXAMPLE |
| p-1 | 11 | 930 | 170 | 40 | 5 | 70 | INVENTIVE EXAMPLE |
| q-1 | 7 | 930 | 150 | 45 | 10 | 60 | INVENTIVE EXAMPLE |
| q-2 | 5 | 910 | 160 | 40 | 5 | 50 | INVENTIVE EXAMPLE |
| q-3 | 9 | 930 | 140 | 30 | 10 | 50 | INVENTIVE EXAMPLE |
| q-4 | 8 | 920 | 150 | 45 | 20 | 70 | INVENTIVE EXAMPLE |
| q-5 | 6 | 920 | 150 | 30 | 10 | 60 | INVENTIVE EXAMPLE |
| q-6 | 7 | 930 | 220 | 40 | 5 | 70 | INVENTIVE EXAMPLE |
| q-7 | 8 | 720 | 140 | 40 | 30 | 60 | COMPARATIVE EXAMPLE |
| q-8 | 6 | 920 | 40 | 30 | 10 | 60 | COMPARATIVE EXAMPLE |
| q-9 | 10 | 900 | 100 | 50 | 2 | 60 | COMPARATIVE EXAMPLE |
| q-10 | 5 | 900 | 150 | 50 | 5 | 90 | COMPARATIVE EXAMPLE |
| q-11 | 5 | 900 | 120 | 55 | 10 | 60 | COMPARATIVE EXAMPLE |
| r-1 | 7 | 940 | 200 | 40 | 5 | 60 | INVENTIVE EXAMPLE |
| A-1 | 5 | 930 | 160 | 40 | 10 | 70 | COMPARATIVE EXAMPLE |
| B-1 | 12 | 920 | 250 | 50 | 20 | 70 | COMPARATIVE EXAMPLE |
| C-1 | 7 | 950 | 120 | 35 | 30 | 60 | COMPARATIVE EXAMPLE |
| D-1 | 5 | 950 | 80 | 30 | 5 | 60 | COMPARATIVE EXAMPLE |
| E-1 | 8 | 940 | 200 | 40 | 10 | 70 | COMPARATIVE EXAMPLE |
| F-1 | 6 | 920 | 160 | 35 | 20 | 70 | COMPARATIVE EXAMPLE |
| G-1 | 8 | 930 | 170 | 35 | 30 | 50 | COMPARATIVE EXAMPLE |
| H-1 | 7 | 950 | 150 | 30 | 5 | 50 | COMPARATIVE EXAMPLE |

TABLE 6

| CON-DITION | STEEL TYPE | AREA FRACTION $V_M$ (%) | $V_B$ (%) | $V_F$ (%) | $V_{\gamma R}$ (%) | $V_M + V_B$ (%) | IRON-BASED CARBIDE COVERAGE FACTOR (%) | NUMBER DENSITY (/μm$^2$) | TENSILE STRENGTH (MPa) | LOW-TEMPERATURE TOUGHNESS | REMARKS |
|---|---|---|---|---|---|---|---|---|---|---|---|
| a-1 | a | 78 | 18 | 0 | 4 | 96 | 83 | 70 | 1213 | ○ | INVENTIVE EXAMPLE |
| a-2 | a | 70 | 27 | 0 | 3 | 97 | 71 | 67 | 1181 | ○ | INVENTIVE EXAMPLE |
| a-3 | a | 96 | 1 | 0 | 3 | 97 | 10 | 65 | 1235 | ○ | INVENTIVE EXAMPLE |
| a-4 | a | 79 | 17 | 0 | 4 | 96 | 65 | 72 | 1207 | ○ | INVENTIVE EXAMPLE |
| a-5 | a | 72 | 25 | 0 | 3 | 97 | 75 | 75 | 1122 | ○ | INVENTIVE EXAMPLE |
| a-6 | a | 98 | 0 | 0 | 2 | 98 | 33 | 54 | 1261 | ○ | INVENTIVE EXAMPLE |
| a-7 | a | 54 | 21 | 17 | 8 | 75 | 30 | 72 | 978 | ○ | COMPARATIVE EXAMPLE |
| a-8 | a | 48 | 40 | 12 | 0 | 88 | 85 | 94 | 897 | X | COMPARATIVE EXAMPLE |
| a-9 | a | 38 | 27 | 35 | 0 | 65 | 85 | 85 | 758 | X | COMPARATIVE EXAMPLE |
| a-10 | a | 80 | 20 | 0 | 0 | 100 | 10 | 28 | 1310 | X | COMPARATIVE EXAMPLE |
| a-11 | a | 85 | 15 | 0 | 0 | 100 | 15 | 35 | 1285 | X | COMPARATIVE EXAMPLE |
| b-1 | b | 84 | 12 | 0 | 4 | 96 | 24 | 75 | 1356 | ○ | INVENTIVE EXAMPLE |
| b-2 | b | 80 | 17 | 0 | 3 | 97 | 25 | 72 | 1326 | ○ | INVENTIVE EXAMPLE |
| b-3 | b | 84 | 13 | 0 | 3 | 97 | 25 | 71 | 1379 | ○ | INVENTIVE EXAMPLE |
| b-4 | b | 87 | 11 | 0 | 2 | 98 | 31 | 78 | 1349 | ○ | INVENTIVE EXAMPLE |
| b-5 | b | 86 | 12 | 0 | 2 | 98 | 20 | 80 | 1372 | ○ | INVENTIVE EXAMPLE |
| b-6 | b | 96 | 0 | 0 | 4 | 96 | 14 | 59 | 1358 | ○ | INVENTIVE EXAMPLE |
| b-7 | b | 42 | 18 | 10 | 30 | 60 | 64 | 77 | 952 | ○ | COMPARATIVE EXAMPLE |
| b-8 | b | 48 | 43 | 0 | 9 | 91 | 82 | 100 | 1012 | X | COMPARATIVE EXAMPLE |
| b-9 | b | 38 | 27 | 35 | 0 | 65 | 85 | 90 | 882 | X | COMPARATIVE EXAMPLE |
| b-10 | b | 80 | 20 | 0 | 0 | 100 | 10 | 33 | 1310 | X | COMPARATIVE EXAMPLE |
| b-11 | b | 85 | 15 | 0 | 0 | 100 | 15 | 39 | 1331 | X | COMPARATIVE EXAMPLE |
| c-1 | c | 78 | 20 | 0 | 2 | 98 | 33 | 80 | 1472 | ○ | INVENTIVE EXAMPLE |
| c-2 | c | 97 | 0 | 0 | 3 | 97 | 45 | 77 | 1496 | ○ | INVENTIVE EXAMPLE |
| c-3 | c | 87 | 10 | 0 | 3 | 97 | 42 | 75 | 1482 | ○ | INVENTIVE EXAMPLE |
| c-4 | c | 91 | 8 | 0 | 1 | 99 | 40 | 82 | 1486 | ○ | INVENTIVE EXAMPLE |
| c-5 | c | 92 | 7 | 0 | 1 | 99 | 35 | 86 | 1488 | ○ | INVENTIVE EXAMPLE |
| c-6 | c | 99 | 0 | 0 | 1 | 99 | 22 | 62 | 1509 | ○ | INVENTIVE EXAMPLE |
| c-7 | c | 43 | 12 | 37 | 8 | 55 | 73 | 82 | 975 | ○ | COMPARATIVE EXAMPLE |
| c-8 | c | 59 | 31 | 10 | 0 | 90 | 87 | 112 | 1112 | X | COMPARATIVE EXAMPLE |
| c-9 | c | 42 | 40 | 18 | 0 | 82 | 95 | 105 | 921 | X | COMPARATIVE EXAMPLE |
| c-10 | c | 85 | 15 | 0 | 0 | 100 | 12 | 35 | 1532 | X | COMPARATIVE EXAMPLE |
| c-11 | c | 85 | 15 | 0 | 0 | 100 | 15 | 42 | 1543 | X | COMPARATIVE EXAMPLE |
| d-1 | d | 88 | 8 | 0 | 4 | 96 | 75 | 78 | 1534 | ○ | INVENTIVE EXAMPLE |
| d-2 | d | 98 | 0 | 0 | 2 | 98 | 15 | 82 | 1509 | ○ | INVENTIVE EXAMPLE |
| e-1 | e | 84 | 15 | 0 | 1 | 99 | 55 | 94 | 1512 | ○ | INVENTIVE EXAMPLE |

TABLE 6-continued

| CON-DITION | STEEL TYPE | AREA FRACTION $V_M$ (%) | $V_B$ (%) | $V_F$ (%) | $V_{\gamma R}$ (%) | $V_M + V_B$ (%) | IRON-BASED CARBIDE COVERAGE FACTOR (%) | NUMBER DENSITY (/μm²) | TENSILE STRENGTH (MPa) | LOW-TEMPERATURE TOUGHNESS | REMARKS |
|---|---|---|---|---|---|---|---|---|---|---|---|
| f-1 | f | 87 | 11 | 0 | 2 | 98 | 65 | 91 | 1522 | ○ | INVENTIVE EXAMPLE |
| g-1 | g | 86 | 12 | 0 | 2 | 98 | 50 | 88 | 1533 | ○ | INVENTIVE EXAMPLE |
| h-1 | h | 80 | 18 | 0 | 2 | 98 | 52 | 97 | 1548 | ○ | INVENTIVE EXAMPLE |
| i-1 | i | 83 | 16 | 0 | 1 | 99 | 50 | 93 | 1512 | ○ | INVENTIVE EXAMPLE |

TABLE 7

| CON-DITION | STEEL TYPE | AREA FRACTION $V_M$ (%) | $V_B$ (%) | $V_F$ (%) | $V_{\gamma R}$ (%) | $V_M + V_B$ (%) | IRON-BASED CARBIDE COVERAGE FACTOR (%) | NUMBER DENSITY (/μm²) | TENSILE STRENGTH (MPa) | LOW-TEMPERATURE TOUGHNESS | REMARKS |
|---|---|---|---|---|---|---|---|---|---|---|---|
| j-1 | j | 87 | 11 | 0 | 2 | 98 | 55 | 89 | 1529 | ○ | INVENTIVE EXAMPLE |
| k-1 | k | 82 | 16 | 0 | 2 | 98 | 60 | 95 | 1544 | ○ | INVENTIVE EXAMPLE |
| l-1 | l | 84 | 15 | 0 | 1 | 99 | 50 | 93 | 1531 | ○ | INVENTIVE EXAMPLE |
| m-1 | m | 81 | 17 | 0 | 2 | 98 | 48 | 96 | 1552 | ○ | INVENTIVE EXAMPLE |
| n-1 | n | 75 | 24 | 0 | 1 | 99 | 64 | 118 | 1782 | ○ | INVENTIVE EXAMPLE |
| n-2 | n | 93 | 6 | 0 | 1 | 99 | 60 | 105 | 1821 | ○ | INVENTIVE EXAMPLE |
| n-3 | n | 95 | 4 | 0 | 1 | 99 | 60 | 101 | 1819 | ○ | INVENTIVE EXAMPLE |
| n-4 | n | 92 | 7 | 0 | 1 | 99 | 65 | 101 | 1832 | ○ | INVENTIVE EXAMPLE |
| n-5 | n | 93 | 5 | 0 | 2 | 98 | 60 | 100 | 1826 | ○ | INVENTIVE EXAMPLE |
| n-6 | n | 98 | 0 | 0 | 2 | 98 | 23 | 97 | 1792 | ○ | INVENTIVE EXAMPLE |
| n-7 | n | 37 | 4 | 52 | 7 | 41 | 50 | 122 | 1154 | ○ | COMPARATIVE EXAMPLE |
| n-8 | n | 53 | 32 | 15 | 0 | 85 | 91 | 110 | 1152 | X | COMPARATIVE EXAMPLE |
| n-9 | n | 38 | 54 | 8 | 0 | 92 | 92 | 118 | 1088 | X | COMPARATIVE EXAMPLE |
| n-10 | n | 90 | 10 | 0 | 0 | 100 | 9 | 28 | 1833 | X | COMPARATIVE EXAMPLE |
| n-11 | n | 85 | 15 | 0 | 0 | 100 | 15 | 35 | 1825 | X | COMPARATIVE EXAMPLE |
| o-1 | o | 98 | 0 | 0 | 2 | 98 | 65 | 88 | 2016 | ○ | INVENTIVE EXAMPLE |
| p-1 | p | 93 | 4 | 0 | 3 | 97 | 64 | 103 | 1986 | ○ | INVENTIVE EXAMPLE |
| q-1 | q | 96 | 1 | 0 | 3 | 97 | 72 | 99 | 2024 | ○ | INVENTIVE EXAMPLE |
| q-2 | q | 94 | 3 | 0 | 3 | 97 | 61 | 100 | 1981 | ○ | INVENTIVE EXAMPLE |
| q-3 | q | 91 | 5 | 0 | 4 | 96 | 75 | 115 | 1970 | ○ | INVENTIVE EXAMPLE |
| q-4 | q | 96 | 1 | 0 | 3 | 97 | 65 | 108 | 2007 | ○ | INVENTIVE EXAMPLE |
| q-5 | q | 93 | 5 | 0 | 2 | 98 | 57 | 104 | 1978 | ○ | INVENTIVE EXAMPLE |
| q-6 | q | 99 | 0 | 0 | 1 | 99 | 15 | 92 | 1984 | ○ | INVENTIVE EXAMPLE |
| q-7 | q | 43 | 7 | 43 | 7 | 50 | 47 | 119 | 1176 | ○ | COMPARATIVE EXAMPLE |
| q-8 | q | 68 | 21 | 11 | 0 | 89 | 85 | 98 | 1163 | X | COMPARATIVE EXAMPLE |
| q-9 | q | 42 | 48 | 10 | 0 | 90 | 90 | 105 | 1241 | X | COMPARATIVE EXAMPLE |
| q-10 | q | 100 | 0 | 0 | 0 | 100 | 10 | 35 | 2021 | X | COMPARATIVE EXAMPLE |
| q-11 | q | 85 | 15 | 0 | 0 | 100 | 15 | 42 | 1994 | X | COMPARATIVE EXAMPLE |
| r-1 | r | 98 | 2 | 0 | 2 | 98 | 20 | 131 | 2038 | ○ | INVENTIVE EXAMPLE |
| A-1 | A | 64 | 35 | 0 | 1 | 99 | 55 | 67 | 1075 | ○ | COMPARATIVE EXAMPLE |
| B-1 | B | 96 | 0 | 0 | 4 | 96 | 10 | 138 | 2539 | X | COMPARATIVE EXAMPLE |
| C-1 | C | 42 | 19 | 36 | 3 | 61 | 75 | 103 | 1124 | ○ | COMPARATIVE EXAMPLE |
| D-1 | D | 52 | 12 | 30 | 6 | 64 | 75 | 99 | 1084 | ○ | COMPARATIVE EXAMPLE |
| E-1 | E | 33 | 44 | 20 | 3 | 77 | 20 | 67 | 993 | ○ | COMPARATIVE EXAMPLE |
| F-1 | F | 96 | 0 | 0 | 4 | 96 | 50 | 41 | 1682 | X | COMPARATIVE EXAMPLE |
| G-1 | G | 32 | 34 | 32 | 2 | 66 | 45 | 77 | 1073 | ○ | COMPARATIVE EXAMPLE |
| H-1 | H | 63 | 21 | 13 | 3 | 84 | 55 | 67 | 1186 | X | COMPARATIVE EXAMPLE |

INDUSTRIAL APPLICABILITY

The present invention may be utilized for industries for manufacturing and utilizing, for example, a hot-stamp part used for automobiles, and others. The present invention may also be used for industries for manufacturing and utilizing another machine structural part.

The invention claimed is:

1. A hot-stamped part comprising:

a chemical composition represented by, in mass %:

C: 0.120% to 0.400%;

Si: 0.005% to 2.000%;

Mn or Cr, or both thereof: 1.00% to 3.00% in total;

Al: 0.005% to 0.100%;

B: 0.0003% to 0.0020%;

P: not more than 0.030%;

S: not more than 0.0100%;

O: not more than 0.0070%;

N: not more than 0.0070%;

Ti: 0% to 0.100%;

Nb: 0% to 0.100%;

V: 0% to 0.100%;

Ni: 0% to 2.00%;

Cu: 0% to 2.00%;

Mo: 0% to 0.50%;

Ca or REM, or both thereof: 0% to 0.0300% in total; and the balance: Fe and impurities; and a structure represented by:

an area fraction of martensite or bainite, or both thereof: not less than 95% in total;

a coverage factor of prior austenite grain boundary by iron-based carbides: not more than 80%; and a number density of iron-based carbides in prior austenite grains: not less than 45/$\mu m^2$.

2. The hot-stamped part according to claim 1, wherein the chemical composition satisfies:

Ti: 0.005% to 0.100%;

Nb: 0.005% to 0.100%; or

V: 0.005% to 0.100%; or any combination thereof.

3. The hot-stamped part according to claim 1, wherein the chemical composition satisfies:

Ni: 0.05% to 2.00%;

Cu: 0.05% to 2.00%; or

Mo: 0.05% to 0.50%; or any combination thereof.

4. The hot-stamped part according to claim 1, wherein the chemical composition satisfies Ca or REM, or both thereof: 0.0005% to 0.0300% in total.

5. A method of manufacturing a hot-stamped part, comprising the steps of:

heating a steel sheet to a temperature of not less than Ac3 point and not more than 950° C. at an average heating rate of not less than 2° C./sec;

then, cooling the steel sheet through a temperature range from a Ar3 point to (Ms point−50)° C. at an average cooling rate of not less than 100° C./sec while performing hot pressing;

changing the average cooling rate at a temperature of (Ms point−50)° C.; and then, cooling the steel sheet through a temperature range from (Ms point−50)° C. to 100° C. at an average cooling rate of not more than 50° C./sec, wherein the steel sheet comprises a chemical composition represented by, in mass %:

C: 0.120% to 0.400%;

Si: 0.005% to 2.000%;

Mn or Cr, or both thereof: 1.00% to 3.00% in total:

Al: 0.005% to 0.100%:

B: 0.0003% to 0.0020%:

P: not more than 0.030%;

S: not more than 0.0100%;

O: not more than 0.0070%;

N: not more than 0.0070%;

Ti: 0% to 0.100%;

Nb: 0% to 0.100%;

V: 0% to 0.100%;

Ni: 0% to 2.00%:

Cu: 0% to 2.00%;

Mo: 0% to 0.50%;

Ca or REM, or both thereof: 0%-0.0300% in total; and the balance: Fe and impurities, and a maximum cooling rate is not more than 70° C./sec and a minimum cooling rate is not less than 5° C./sec in a temperature range from (Ms point−120)° C. to 100° C., thereby producing the hot-stamped part of claim 1.

6. The method of manufacturing the hot-stamped part according to claim 5, wherein the chemical composition satisfies:

Ti: 0.005%-0.100%;

Nb: 0.005%-0.100%; or

V: 0.005%-0.100%; or any combination thereof.

7. The method of manufacturing the hot-stamped part according to claim 5, wherein the chemical composition satisfies:

Ni: 0.05%-2.00%;

Cu: 0.05%-2.00%; or

Mo: 0.05%-0.50%; or any combination thereof.

8. The method of manufacturing the hot-stamped part according to claim 5, wherein the chemical composition satisfies Ca or REM or both thereof: 0.0005%-0.0300% in total.

* * * * *